US006886222B2

(12) United States Patent
Vitry

(10) Patent No.: US 6,886,222 B2
(45) Date of Patent: May 3, 2005

(54) MOMENTUM LOCKOUT DETENTED-DAMPENED HINGE

(75) Inventor: Fabrice Vitry, Worcester (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/617,576

(22) Filed: Jul. 11, 2003

(65) Prior Publication Data

US 2004/0070213 A1 Apr. 15, 2004

Related U.S. Application Data

(60) Provisional application No. 60/395,536, filed on Jul. 12, 2002.

(51) Int. Cl.[7] ..... E05D 11/10
(52) U.S. Cl. ..... 16/352; 16/349
(58) Field of Search ..... 16/352, 344, 345, 16/349

(56) References Cited

U.S. PATENT DOCUMENTS

| | | | | |
|---|---|---|---|---|
| 2,162,663 A | | 6/1939 | Lockhart | |
| 3,515,433 A | * | 6/1970 | Tabor | 297/374 |
| 3,801,155 A | * | 4/1974 | Hodgen et al. | 297/374 |
| 4,018,400 A | | 4/1977 | Henderson | |
| 4,114,235 A | * | 9/1978 | Remington | 16/321 |
| 4,146,320 A | | 3/1979 | Scharder | |
| 4,228,562 A | * | 10/1980 | Hsu | 16/313 |
| 4,342,135 A | | 8/1982 | Matuso et al. | |
| 4,468,836 A | | 9/1984 | Omata | |
| 4,672,715 A | | 6/1987 | Beckwith | |
| 4,763,926 A | | 8/1988 | Doty | |
| 4,861,948 A | | 8/1989 | Fogleman | |
| 5,001,809 A | | 3/1991 | Kim et al. | |
| 5,121,521 A | * | 6/1992 | Hagiwara et al. | 16/278 |
| 5,412,842 A | * | 5/1995 | Riblett | 16/334 |
| 5,452,501 A | * | 9/1995 | Kramer et al. | 29/11 |
| 5,660,097 A | * | 8/1997 | Nomura et al. | 92/12.2 |
| 5,839,548 A | | 11/1998 | Parker et al. | |
| 5,862,896 A | | 1/1999 | Villbrandt et al. | |
| 6,367,124 B1 | | 4/2002 | Bella eta l. | |
| 6,393,664 B1 | * | 5/2002 | Habegger et al. | 16/335 |
| 6,662,405 B1 | * | 12/2003 | Vitry | 16/355 |
| 6,684,455 B1 | * | 2/2004 | Mertin | 16/334 |

FOREIGN PATENT DOCUMENTS

JP 2003-026172 11/2002

* cited by examiner

*Primary Examiner*—Suzanne Dino Barrett
*Assistant Examiner*—Mark Williams
(74) *Attorney, Agent, or Firm*—Paul & Paul

(57) ABSTRACT

A detented and dampened hinge mechanism, with push-pull, and pull-push operation includes a first and second arms pivotally connected to move relative to one another in a scissor fashion between a closed and open positions. A cam and cam follower track establish a detent-type hold at both closed and open positions and add a radial motion component to the general pivotal motion. A damper limits relative movement of the arms. A biasing spring is utilized to bias the first and second arms toward the open position. A free moving anti-gravity ball moves in a channel when a momentum is imparted to the hinge mechanism. With the ball in its normal, lower position, arms are free to move; and moved to an upper position, the arms become locked out from full movement by the interference of the ball. Bumper materials are added.

20 Claims, 18 Drawing Sheets

MOMENTUM LOCKOUT DETENTED-DAMPENED HINGE

This application claims priority of U.S. provisional application No. 60/395,536, filed Jul. 12, 2002, in the United States Patent and Trademark Office, and incorporates the disclosure thereof as if presented below in full.

BACKGROUND OF THE INVENTION

The present invention relates generally to hinge mechanisms with push-pull operation. Particularly, the invention relates to such hinge mechanisms, which may be detented to hold a particular position and may have a dampened movement when subjected to the pull-push operation.

Hinge mechanisms, scissor arms, and latches having push-push operations are known in the art. An example of this type of latch is shown in U.S. Pat. No. 4,655,489, issued on Apr. 7, 1987, to Robert H. Bisbing. The latch disclosed in this patent operates by capturing a keeper attached to a door or panel when the keeper is initially pushed into the latch housing. The keeper is released by again pushing the keeper into the housing to disengage the keeper from a catch within the housing, hence the term push-push latch.

Some other hinge mechanisms have gravity operated lockouts. Bako et al., U.S. Pat. No. 5,106,132, issued Apr. 21, 1992 shows a gravity operated lockout ball for a suitcase closure device. Wilstermann, U.S. Pat. No. 4,906,044, shows a gravity operated lockout ball for an automotive arm rest latch. In each instance the Bako and Wilstermann ball rolls downward under the force of gravity to create a lockout condition. These gravity operated lockout balls prohibit the movement of a hook-ended lever from a keeper. There is no suggestion nor is there consideration given in the prior art for adapting a lockout ball to scissor arm type latch. In fact, scissor arm type latches have a structure, which has not been adapted to a lockout ball operation.

An object of the present invention is to provide and improved hinge mechanism with a smooth opening and closing operation.

A second object of this invention is to provide such improved hinge mechanism with a fixedly controlled open position and a fixedly controlled closed position.

A third object of this invention is to provide such a hinge mechanism with controlled biasing for positive movement once said hinge is moved out of its fixed open or fixed closed position and where this biasing includes resonance vibration absorption.

A further object of this invention is to provide such a hinge mechanism with structural components for ease of assembly, low profile structure, and reliable operation and with quieting materials.

An even further object is to provide a momentum activated lockout when the latch is in the closed position.

SUMMARY OF THE INVENTION

The objects of the present invention are realized in a detented and dampened hinge mechanism with push-pull and pull-push controlled-rate operation. This hinge has a low profile, scissor-style structure, which is suitable for operating a vehicle glovebox lid, or bin, door pocket or boot side access panel or bin, and the like.

Detent forces assist in holding the closed position and the open position, each of which detent forces, in turn, are overcome by an operator's manual movement of the structure. A momentum sensitive device, such as an anti-gravity ball, operates to block the movement of the hinge from the closed position in the presence of excessive forces created during a predetermined excessive change in vehicle momentum, and other types of acceleration forces (both positive and negative acceleration). These forces may arise during a jarring, shock, of sudden acceleration or sideways deceleration, as experienced in an accident or with erratic driving, or in the case of door pockets, when slamming a door shut.

The hinge has a first elongate arm and elongate second arm, which move relative to one another in the plane of their elongations thereby pivoting in the scissor-like operation with added radial translation motion for the detent functions. A spring biases the scissor arms, and thereby the hinge, to each extreme position. A dampener operates against arm movements in both directions for push-pull and pull-push operation. A cam cooperates with a curvilinear cam path to implement an articulated motion between the first and second arms as they move relative to one another. This articulation compensates for variations in mounting positions for various applications between different glovebox, bin and door pocket designs.

The hinge has its first arm fixedly attachable to a first non-movable structural member, such as a glovebox encasement. It has its second arm, being pivotally connected to the first arm, fixedly attachable to a movable structural member, such as a glovebox lid or bin, door pocket or boot side access panel or bin. Thereby when the arms are moved relative to one another between the first closed position and the second open position, the two structural members move relative to one another.

The second arm carries the damper mechanism that is fitted or snapped into a cutout of that second arm. The damper can engage a portion of the first arm and thereby create a controlled movement between the first and second arms. This controlled movement is an inhibiting force that acts against any excessive pivoting motion during normal operation.

The damper mechanism includes a pinion gear mounted on the second arm. The pinion gear is connected to a friction clutch or a hydraulic clutch, being in this case a hydraulic clutch surrounded with high viscosity silicone lubricant. Different types of lubricant can be used to obtain the desired controlled motion. This pinion gear operates with its teeth engaging a track or length of teeth mounted on the first arm. This length of teeth forms a curved shaped track, i.e. a "rack" with a depression at the closed position end thereof. This depression assists in the closed position detent function. The pinion rotates and traverses the rack, as the hinge arms move between open and closed positions, it thereby operates against the associated clutch force for controlling the normal opening and closing movements of the associated glovebox lid or bin, door pocket or boot side access panel or bin.

The spring is connected between respective hooks, or alternatively between bosses located on each of the two arms. The connection locations on the arms are selected with respect to the pivot location and the configuration of the arms. The spring force is selected to match the damper, door weight, and other factors which are considered. The detent function is implemented with concave surfaces incorporated at both ends of the curvilinear cam follower track or path. The cam abuts the end of the cam follower path when the hinge is in the extreme open position, i.e., when rotated or pivoted to this position. The position of the cam in the closed position is given by the height and shore hardness of the vehicle's rubber stops mounted on the fixed element or moving element of the vehicle glovebox unit, door pocket unit or boot side access panel or bin unit, i.e., the lid itself or the frame.

In the door pocket application, the rubber stops are mounted on the door trim and when the pocket closes, it comes in contact with a rubber stop. The rubber stop assures that there is no direct contact between the pocket and the door trim, thus absorbing any noise when slamming the pocket shut, or vibration noise when in the closed position and the vehicle engine is at idle, or when the vehicle is moving.

The hinge of this invention allows for slight variations in the height and softness of the rubber stops, and for the possible distortion of in the bins or lids. The hinge adjusts to ensure that its cam member can always travel further down its cam follower track or path. The hinge also, if required, can compensate for these variations and can compensate to keep a preload on the glovebox lid or bin, door pocket or boot side access panel or bin, as the installation may be, from forcing the lid or bin to open. Therefore, the specific glovebox lid or bin, door pocket or boot side access panel or bin remains closed until opened by the operator. This ensures that the attached structure always remains closed and are properly shut, and also under vibration or shock pressure, will not rattle or open.

In addition to the preload weight encountered when the structure is in the closed position, the hinge provides a resistance against opening. This arises as the hinge is mounted so that the surface of the cam follower track or path in the closed position area is at a relative 45 degree angle (inclined) to the direction of the opening force. (The closed position area is that region of the track engaged by the pinion gear when the arms are rotated to place the hinge in its closed state.) This establishes a track incline area, which acts as a large detent area.

In this detent area, the rate of radial motion is greater than the rate of pivotal motion (when the hinge opens the first four degrees), and this makes the second arm translate in a perpendicular fashion towards the opening effort direction. This results in a higher opening effort during the first four degrees of rotational motion and defines a detent area rather than a fixed detent point at (or in) the closed position. (A detent point would be at a predetermined point at a specific angle of rotation.)

The resultant detent area renders the hinge more operator friendly (and wear forgiving) as it provides the detent function over a wide band (of angular rotation) thereby establishing a wide band of closed position tolerance. Moreover, with the detent area, small inconsistencies between installations are not as critical. This becomes a factor when two hinges are installed on a single structure, i.e., one on either side.

The strength of the detent area is adjusted by the angle of the cam follower path or track at the closed position. (Strength of the detent area is the force needed to move out of the detent.) The angle for the path is typically 45 degrees to the opening effort direction, but can be lower to reduce the strength (forces required to move the hinge) and higher than 45 degrees to increase the strength needed (to open the hinge). It is understood that curvilinear path for the gear track follows the path of the cam follower slot, i.e., guide-way or path.

The second, movable arm can pivot on an open socket formed in its heel end. This socket mates with a boss located near the lower end of the first, fixed arm. This open socket is slightly elongate which permits the second arm to move radially outwardly off of a deep-seated position, when the arm rotates from the closed position. This permits the articulation motion referred to above. The biasing spring position and its spring force operates to seat the elongate socket on its mating boss when the second arm is in the closed position. This is applicable in the absence of rubber stops, when the hinge installation requires that there should be a clearance gap between the lid or bin and the glovebox, or other housing's, mounting frame or door trim. In this case, the second arm moves to the extreme closed position and thereby defines the closed position for the respective lid or bin.

This extreme closed position is also the normal state of the hinge during shipment and prior to installation. In the case where rubber stops are found in an installation, the hinge should be positioned and fixed on the glovebox frame or door trim such that in the closed position the second arm socket falls just short of its mating boss in order to allow the rubber stops to function in dampening the lid or bin force when contacting the respective frame or trim.

A PVC (polyvinyl chloride) sleeve is positioned over a sufficient portion of the spring's body to dampen spring vibration noise when the hinge slams to the open or to the closed position. Known TPE (thermoplastic elastomer) materials are molded into abutment surfaces for dampening the shock force and noise created at mechanical stop surfaces. Examples of TPE materials may include talc-loaded polypropylene and may include (SEBS) poly-styrene-b-ethylene-co-butylene-b-styrene, or other suitable polymer-bonded materials.

The fixed arm carries a channel in which the anti-gravity ball operates. This ball has a predetermined mass, which permits it to move at a predetermined rate from a non-lockout position at one end of its channel to a lockout position at the other end of its channel, under incurred excessive acceleration forces. The channel angle and the mass of the ball are also affected by the design parameters for the hinge, including the design parameters of the damper structure, the biasing spring and the average weight exerted by the glovebox lid or bin, door pocket or boot side access panel or bin and the weight of the contents inside. The momentum imparted to the ball causes it to travel to the lockout position. Gravity causes the ball to return to the non-lockout position after the acceleration induced momentum force effect subsides. Typically, the channel is oriented at approximately a forty-five degree angle with the non-lockout position being at the bottom.

The channel provides an enclosure to hold the free moving ball. Such enclosure may project beyond the outside wall of the second, movable arm, when a larger sized ball is need. Alternately, when the anti-gravity ball size permits, the channel may be shaped into a wall of the second arm. In either case, an interlock or a stop surface must be engaged on the first, fixed arm. This interlock can be a shaped abutment, or a socket, or another structure into which the ball can roll to thereby be pinned against the interlock, resulting in the lockout condition. This lockout condition will last for the duration of any excessive acceleration and resultant momentum imparted to the ball.

BRIEF DESCRIPTION OF THE DRAWINGS

The features, advantages and operation of the present invention will become readily apparent and further understood from a reading of the following detailed description of the invention with the accompanying drawings, in which like numeral refer to like elements, in which.

DETAILED DESCRIPTION OF THE INVENTION

The present invention provides a motion lockout, detented and dampened hinge mechanism. A shock or acceleration (being a positive or negative acceleration), can cause a lockout member to prohibit the hinge from opening from its closed position. The hinge has a low profile scissor configuration having two arms, which are spring biased to the closed hinge position. Mechanical detents are utilized at either end of the scissoring operation to detent both the closed and the open positions. Soft materials are used to dampen spring vibration noise. Soft materials are also used a abutment locations to dampen abutment noises.

Figure 1:
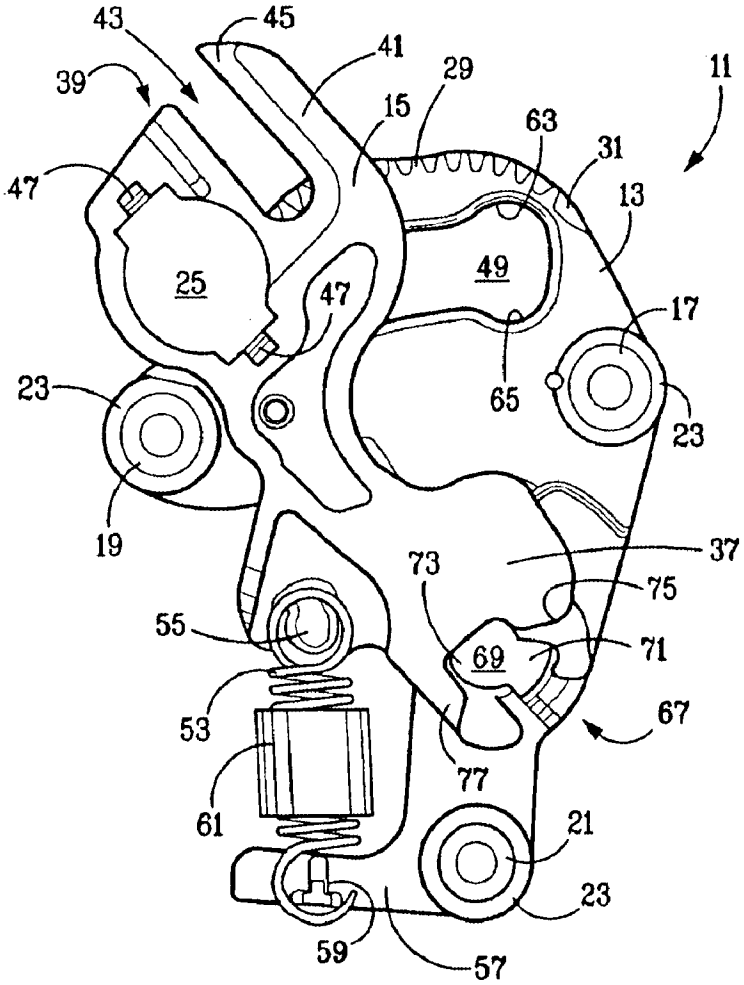
FIG. 1 is frontal view of the assembled hinge mechanism of the present invention showing in the closed position with the first/fixed arm in the background and the second moveable arm in the foreground.

The scissor hinge mechanism 11, shown in a front view in the closed position, FIG. 1, includes a first/fixed arm 13 and a second/movable arm 15 mounted for rotation thereon. The first/fixed arm 13 carries three mounting bosses 17, 19, 21 for mounting the fixed arm to a fixed bin or pocket or glovebox compartment structure, or the like with mounting screws. The first mounting boss 17 is situated at the upper most area of the fixed arm at, what will be further described below as, the open position location of the fixed arm 13. The second mounting boss 19 is located at the closed position location of the fixed arm 13, while the third mounting boss 21 is located at the bottom of the fixed arm 13. These bosses 17, 19, 21, each have an upstanding cylindrical wall 23, extending outwardly from the juxtaposed/inside face of the fixed arm 13 a distance above the mounting screw head, seating surface. For the first and second bosses 17, 19, the cylindrical wall will present and abutment for the extreme end of rotational motion of the movable arm 15.

Figure 2:
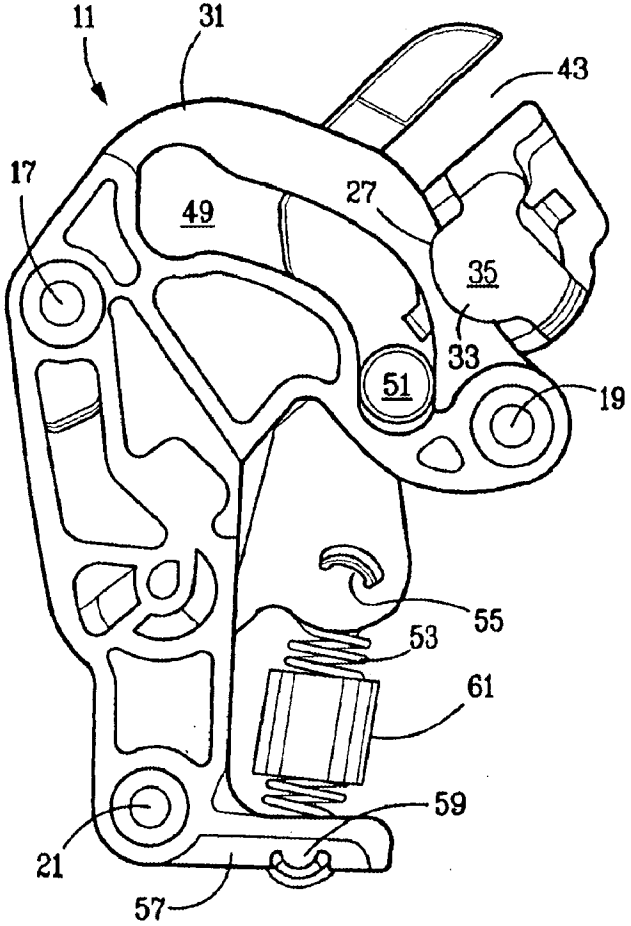
FIG. 2 is a reverse or back view of the closed hinge mechanism of FIG. 1.

The movable arm carries a damper structure, which includes a friction clutch or hydraulic clutch surrounded by high viscosity silicone lubricant. The damper has a pinion gear (described below), FIG. 2, which operates in conjunction with a toothed track or rack 29, FIG. 1. FIG. 2 is shows the hinge mechanism closed from a back view. A projecting back flange FIGS. 1, 2, provides an interlock structure for holding the movable arm 15 on the fixed arm 13, when this projecting back flange is overlapped by a projecting lip 33, FIG. 2, on the back cover 35 of the damper structure 25.

Both the fixed arm 13 and the movable arm 15 are irregularly, elongate shaped. The movable arm 15 is mounted to rotate on the fixed arm from its bottom or heel portion. The hinge 11 is generally mounted so that the two arm 13, 15 elongations extend essentially vertically. The outward end 39 (opposite the heel 37) of the movable arm 15 has a fork structure 41, which creates and open ended elongate slot 43. This slot 43 receives a pin or post mounted to a movable member, such as a lid, bin, door pocket, access panel or bin and the like. As the movable arm 15 moves, the movable member is moved. The slot 43 is sided (surrounded) by a depression surface 45, which is the seating surface for the head of the movable member's post.

The damper structure 25 is located at the outward end 39 of the movable arm 15, adjacent the elongate slot 43. This damper structure 25 snaps into a receiving hole in the movable arm and is held in place by diametrically positioned compression fingers 47.

Positioned at the outward end of the fixed arm 13 is a curvilinear shaped cam follower path or cam slot 49, FIGS. 1,2. A solid cylindrical projection 51 extending outwardly from the juxtaposed/inside face of the movable arm 15 acts as the cam 51 and extends through the cam slot 49. A coil spring 53 mounts between an intermediate location on the movable arm 15 where an attachment, such as the first hook 55, is located, and a projecting lower leg 57 of the fixed arm 13, where a second hook 59 is located. The coil spring 53 carries a cylindrical PVC sleeve 61 the majority of its unextended length. This PVC sleeve absorbs spring vibration noise when the hinge 11 is slammed open or closed.

The open position end of the cam slot 49 has transversely extending upper and lower concave pushouts 63, 65. The upper pushout 63 permits ease of assembly of the movable arm 15 on the fixed arm 13. The lower pushout 65 acts as an open position detent. The depth of this lower pushout 65 and the extended spring 53 force determine the open position detent strength.

The heel end 37 of the movable arm 15 is fork shaped with an elongate slot 67. An outwardly extending journal 69 on the juxtaposed/inside face of the fixed arm 13 acts as the pivot for the rotation of the movable arm 15. This journal 69 has a pair of diametrically opposed, transversely extending lobes 71, 73 at its outer end. The first lobe 71 points away from the first hook 55 location and is used to overlap the right fork arm 75 of the heel 37 when the movable arm 15 is in the extreme open position. The second lobe 73 points towards the first hook 55 location and is used to overlap the left fork arm 77 when the movable arm 15 is in the extreme closed position. Both the right and left fork arms have undercut surfaces 79, 81, FIG. 3, with the right fork undercut 79 extending under the first lobe 71 and the left fork undercut 81 extending under the second lobe 73.

Figure 4:
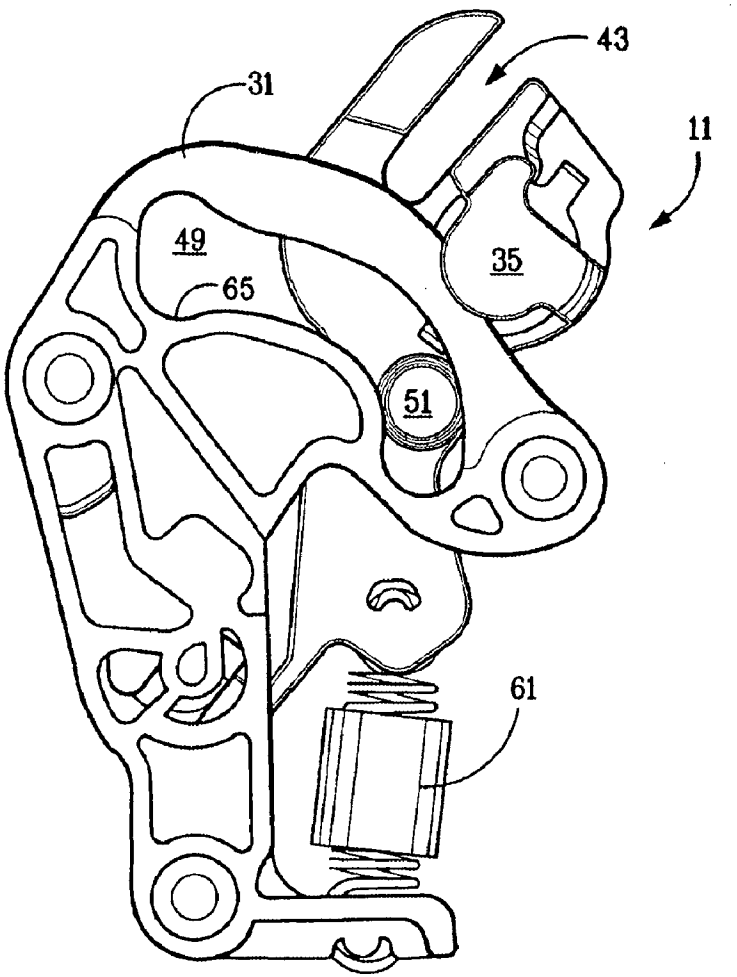
FIG. 4 is a back view of the locked-out hinge of FIG. 3.
Figure 3:
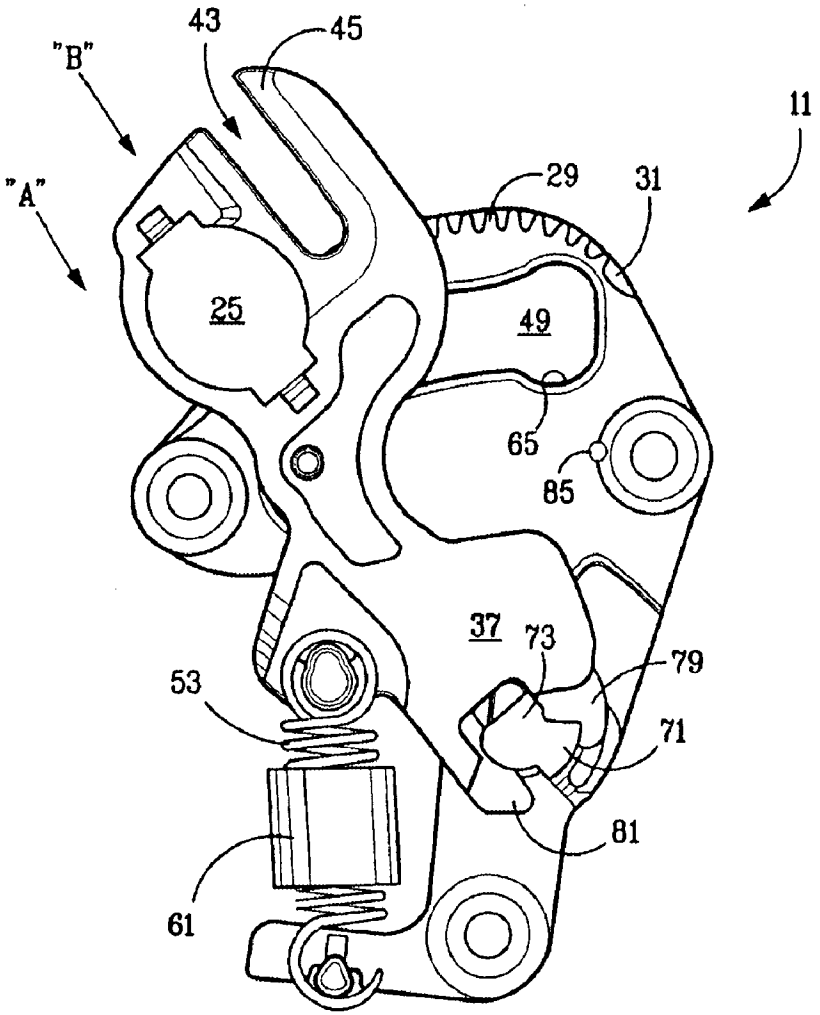
FIG. 3 is a frontal view of the hinge of FIG. 1 in the locked-out position.

The lockout member is a metal ball 83 discussed further below, and hidden (not shown) in FIGS. 1–3. A soft touch bumper 85 is positioned at the movable arm 15 contact point on the first mounting boss 17, FIG. 3. FIGS. 3–4 also show the lockout position, i.e., the anti-gravity lock, of the hinge 11, with FIG. 3 being a front view and FIG. 4 being a back view. This lockout position "A" is established at a rotation of about 4 degrees from the fully closed position "B". How this lockout position "A" is determined is discussed below.

Figure 6:
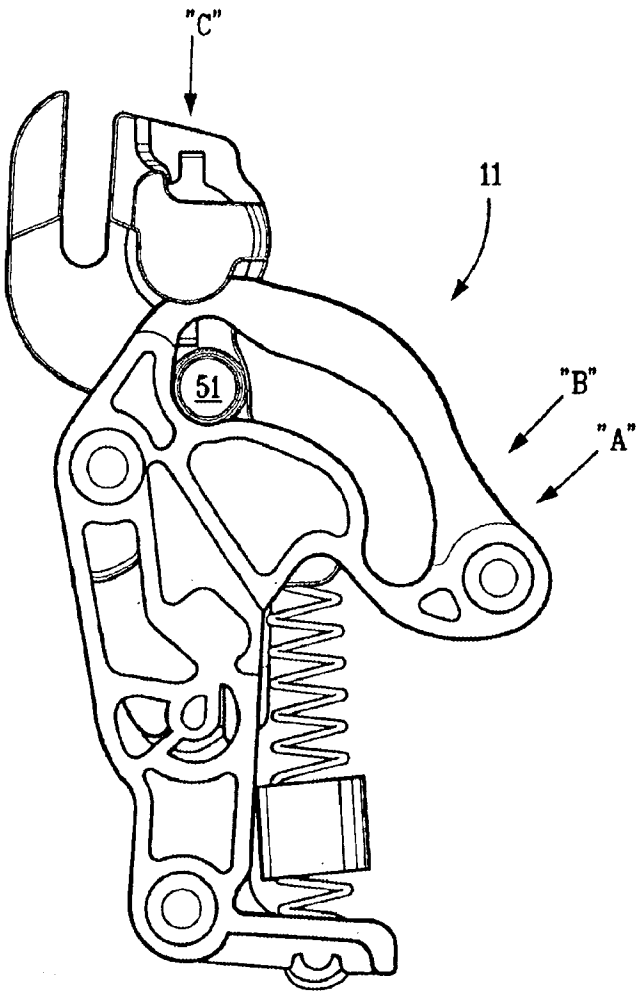
FIG. 6 is a back view of the open hinge of FIG. 5.
Figure 5:
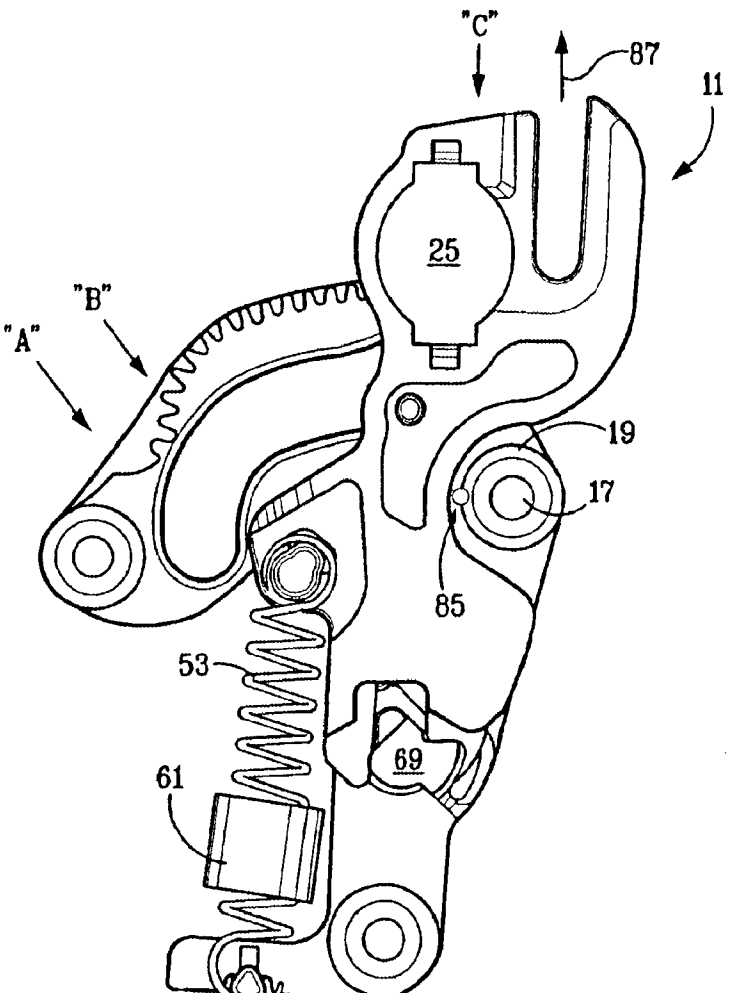
FIG. 5 is a frontal view of the hinge of FIG. 1 in the open position.

In FIGS. 5–6, which show the hinge 11 mechanism in the open and the closed positions respectively, the movable arm 15 has moved to the fully open position "C" to abut the TPE soft touch bumper 85 on the cylindrical wall 19 of the first mounting boss 17.

When the hinge 11 is in the fully open position "C" the spring 53 is fully extended and the movable arm 15 has moved radially outward 87 following the cam slot 49 shape. In the fully closed position "A" the movable arm 15 seats completely down on the journal 69 as seen in FIG. 1. As the movable arm 15 begins to rotate from the fully closed position, it also begins to articulate, i.e., to move radially outwardly as can be seen in FIG. 2. The fully open position "C" shows the hinge fully opened and the movable arm fully rotated and fully extended outward in the radial direction 87, FIG. 3. This articulation is a design consideration for operating variety of gloveboxes, door pockets, boot access panels/bins, and the like.

Figure 8:
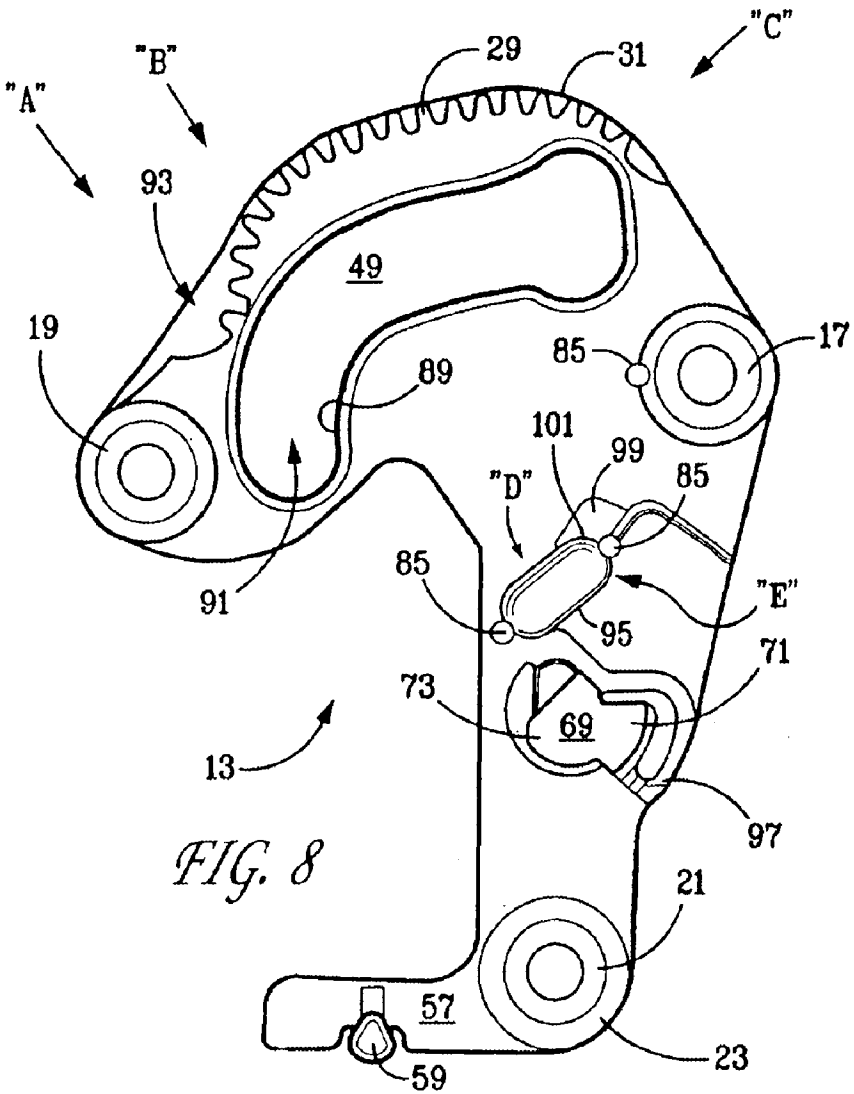
FIG. 8 shows the juxtaposed/inside face of the fixed arm of FIG. 7.
Figure 7:
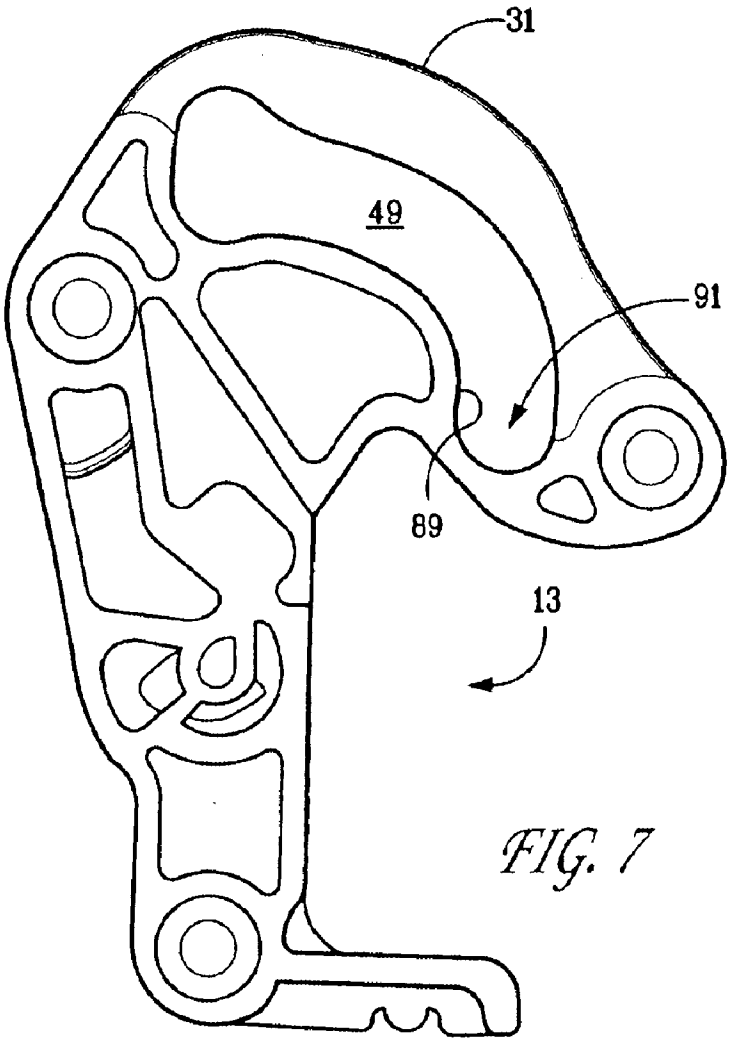
FIG. 7 shows a back/outside view of the first/fixed arm of the hinge mechanism of FIG. 2.

FIGS. 7, 8 show the outside face and inside face, respectfully, of the fixed arm 13. The shape of the curvilinear cam slot 49 is easily seen. The closed position "A" end of the cam slot 49 dips downward to form an inclined region 89 of the bottom cam slot edge. This downward projecting region 91 and the inclined region 89 of the bottom cam slot edge provide a detent function at the closed position "A" and the area of rotation immediately adjacent the closed position "A". The length of this detent area is a design consideration in the force used in the opening operation of the hinge 11. The toothed track, rack 29 dips downward for a parallel region 93 to follow the dip 91 in the cam slot 49.

A closed ended channel 95 for holding the ball 83 is positioned in the juxtaposed/inside face of the fixed arm 11, FIG. 8. This channel has TPE soft touch bumpers 85 at each closed end. The channel 95 permits the ball 83 to roll between a first position "D" and a second position "E", with the "D" position being the non-lockout position and the second position "E" being the lockout position. The sidewalls of the channel 95 can have any shape, which will permit the ball 83 to freely roll between positions "D" and "E". However, if the sidewalls of the channel 95 are rounded to provide a "neater fit" with the ball and reduce side play, the operation of the ball in the channel will be less noisy and without significant rattling.

The journal 69, FIG. 8, upon which the heel 37 end of the movable arm 15 rotates has its two lobes 71, 73 being pie-shaped or fan-shaped. The first lobe 71 has an upstanding wall 97 which rises from the surface of the inside face of the movable arm 15 at the edge of the lobe 71 closest to third mounting boss 21. This upstanding wall 97 is an additional abutment for the end of the right fork arm 75 at the heel end of the movable arm 15 when that arm 15 is in the fully open position "C". The second hook 59, in the projecting lower arm 57, is formed as an upstanding projection from the inside face of the fixed arm 13.

A spacer block 99 is at the lockout end "E" of the channel near the side facing the cam follower slot 49. This first spacer block 99 acts as a spacer to assure that the two arms 13, 15 are sufficiently separated to allow the free operation of the ball 83. A concave cutout 101 in this first spacer block 99 abuts the channel and is a size and shape to receive the ball 83 in the lockout position "E".

Figure 10:
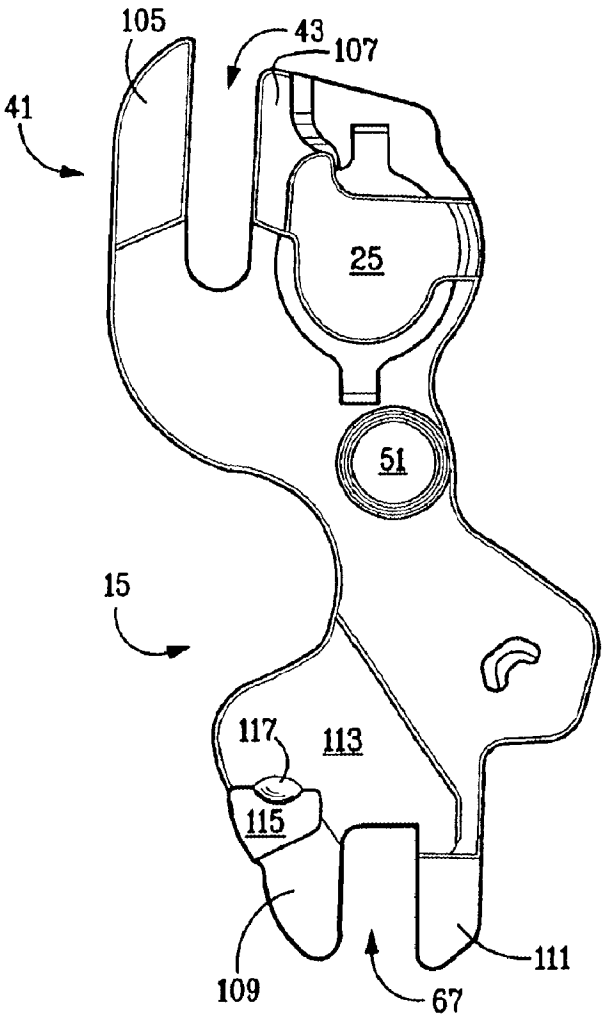
FIG. 10 shows the juxtaposed/inside face of the movable arm of FIG. 9.
Figure 9:
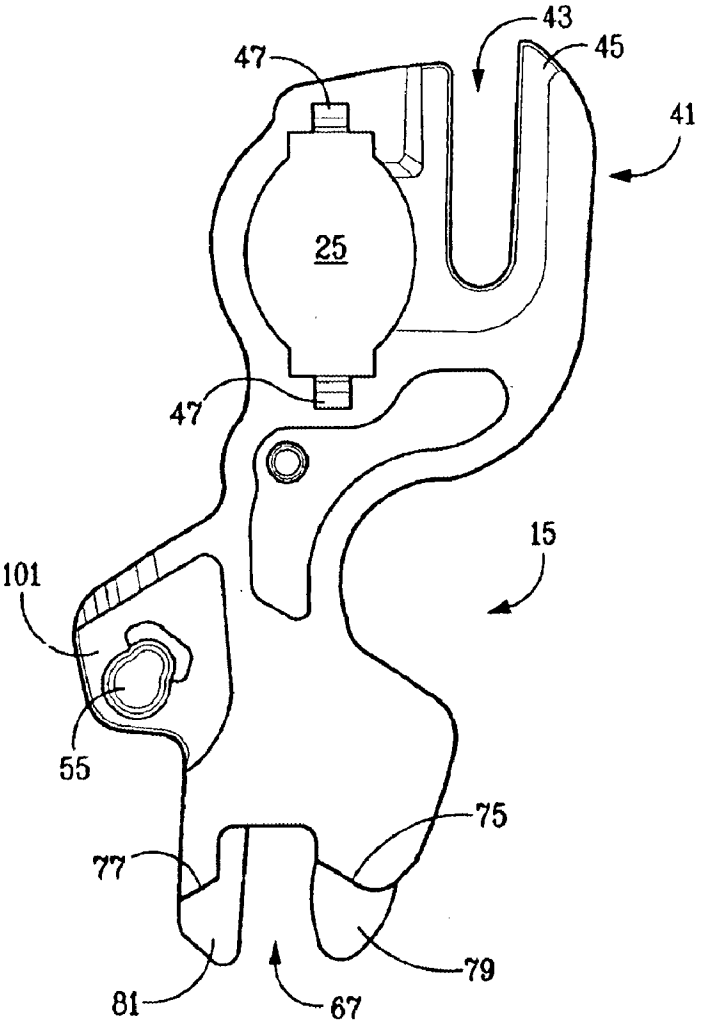
FIG. 9 shows the frontal/outside face of the movable arm of the hinge mechanism of FIG. 1.

FIGS. 9–10 show the outside face and inside face, respectively, of the movable arm 15, respectively. Referring to the outside face, FIG. 9, the undercut section 45 forming the depressed surface is easily understood. The tab-like shapes of the respective right and left undercut surfaces 79, 81, in the right and left fork arms 77, 79 at the heel end of the movable arm 15 are easily seen to be a size and shape to match the first and second lobes 71, 73 of the fixed arm's 13 journal 69. The right undercut 79 is essentially shovel shaped, while the left undercut 81 has a projecting tang at its base. The spring 53 attachment first hook 55, on the movable arm 15, FIG. 9, projects outwardly from the outside face at an undercut area 99. This spring undercut area 103 permits the spring 53 to be positioned in a lower profile at a plane about where the inside faces of each arm 13, 15 abut. This aligns the spring 53 force with the scissor plane and eliminates binding of the arms 13, 15.

Buildup shoulders 105, 107 surround the elongate slot, FIG. 10, at the fork 41 end of the movable arm 15. These shoulders assure the resultant thickness of the fork 41 and compensate for the undercut 45. Therefore the arm 15 is not weakened in the fork 41 area and will not break in operation. Compensating buildup shoulders 109, 111 also surround the heel slot 67 and provide thickness to compensate for the undercuts 79, 81, respectively.

An irregular but truncated trapezoidal-like shaped undercut area 113 is positioned to extend towards the damper 25 end of the arm 15 from the bottom of the heel slot 67. This undercut provides the spacing for the operation of the ball 83 in the channel 95 and the pivoting of the arms 13, 15 without binding against the ball 83. A dimpled pad 115 operates as a second spacer block 115 for assuring the spacing between the arms 13, 15 for the free operation of the lockout ball 83. A concave cutout 117 is of a size and shape to receive the ball 83. This second cutout 117 faces away from the heel slot 67 and acts to abut the ball 83 in the lockout position "E" and pin it against the cutout 101 in the spacer block 99 when the hinge 11 is locked out in the closes position.

Figure 11:
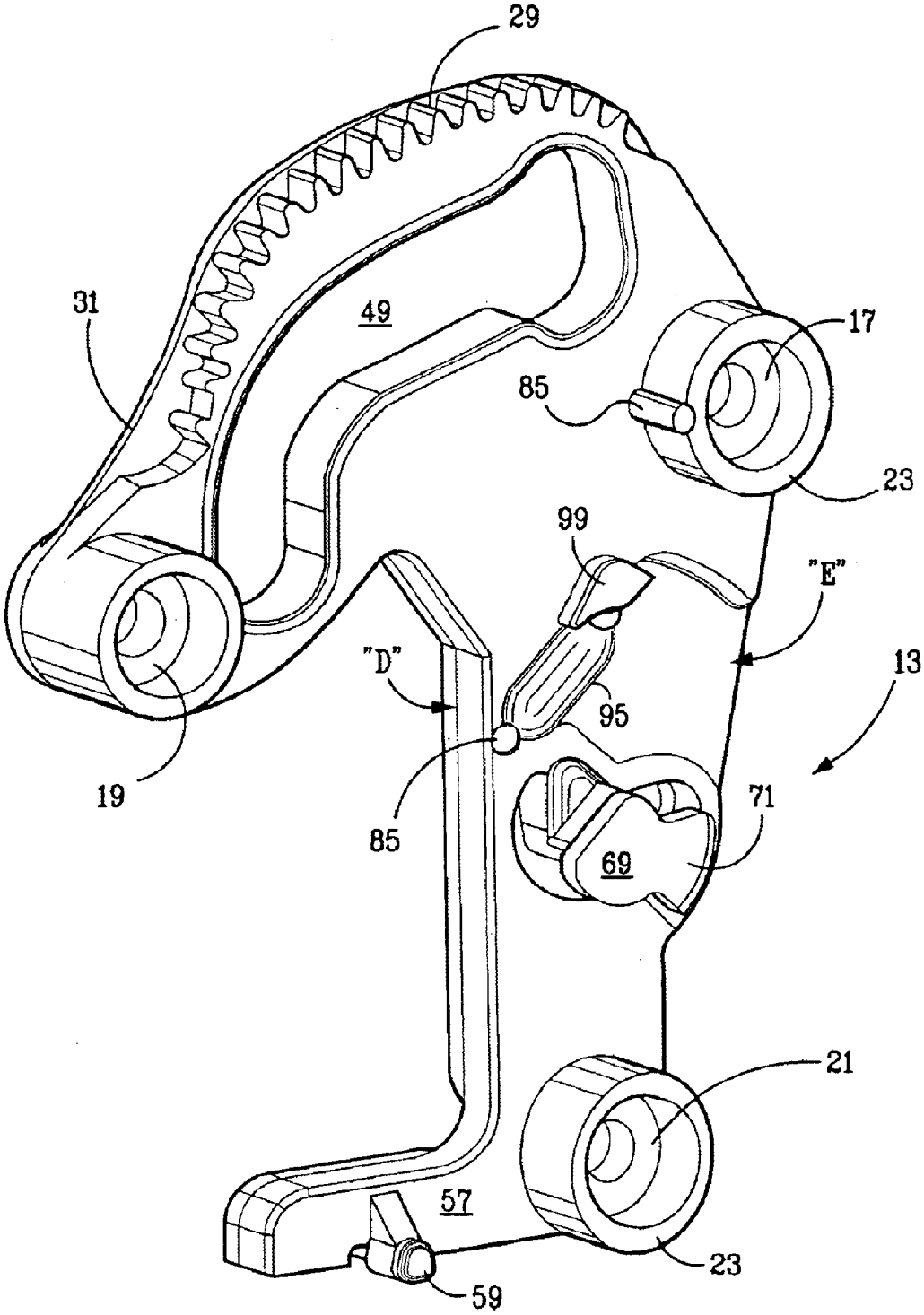
FIG. 11 is a perspective view seen from the left of the inside face of the fixed arm of FIG. 8.
Figure 12:
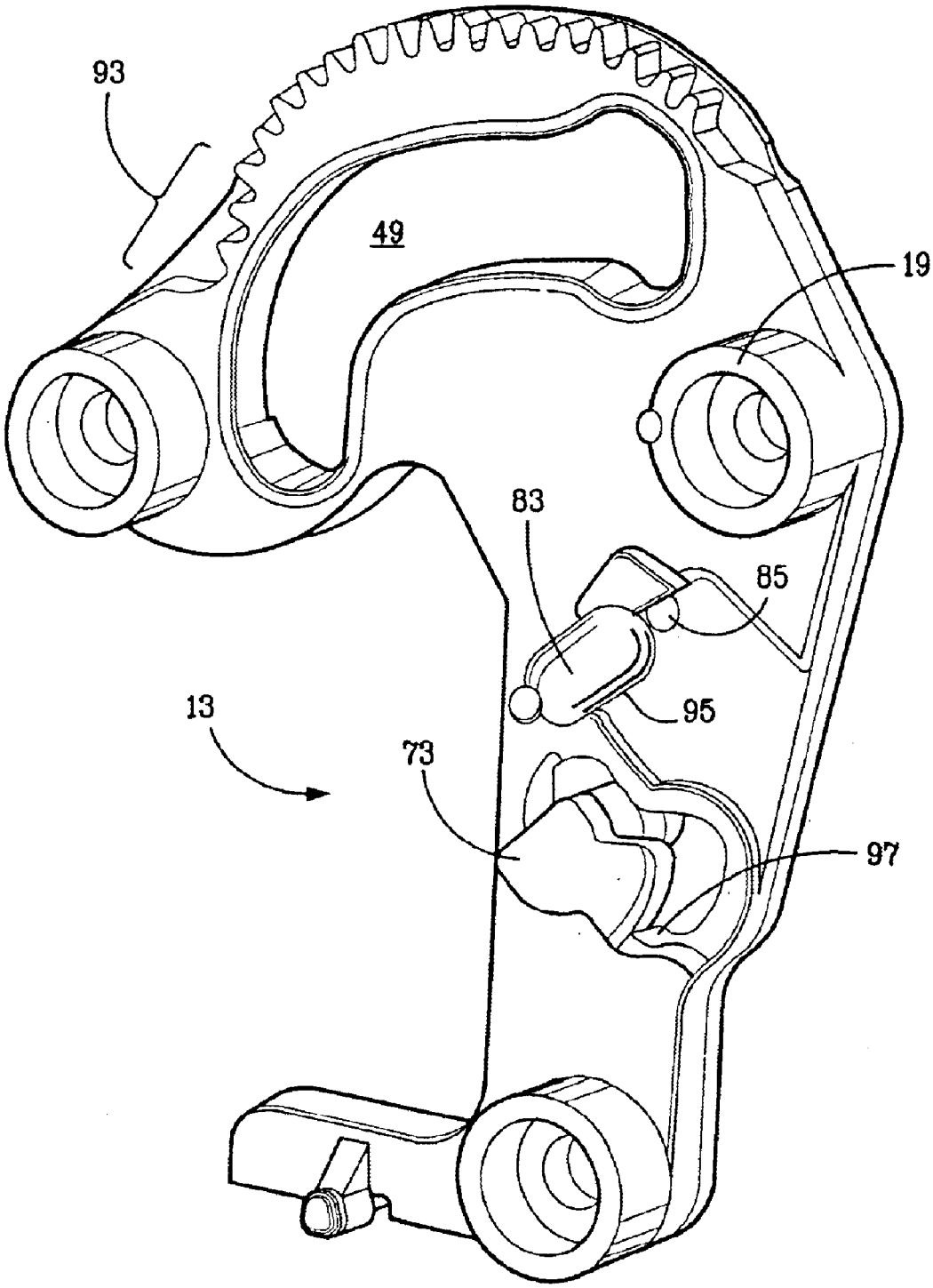
FIG. 12 is a right perspective view of the inside face of the fixed arm of FIG. showing the lockout ball in the non-lockout location.

FIGS. 11 and 12 are left and right perspective views, respectively, of the inside face of the fixed arm 13, and further illustrate the shapes of the elements above-described. The steel ball 83 is shown in filled-in (black) is positioned at the lower, non-lockout location, in the channel 95, FIG. 12.

Figure 13A:
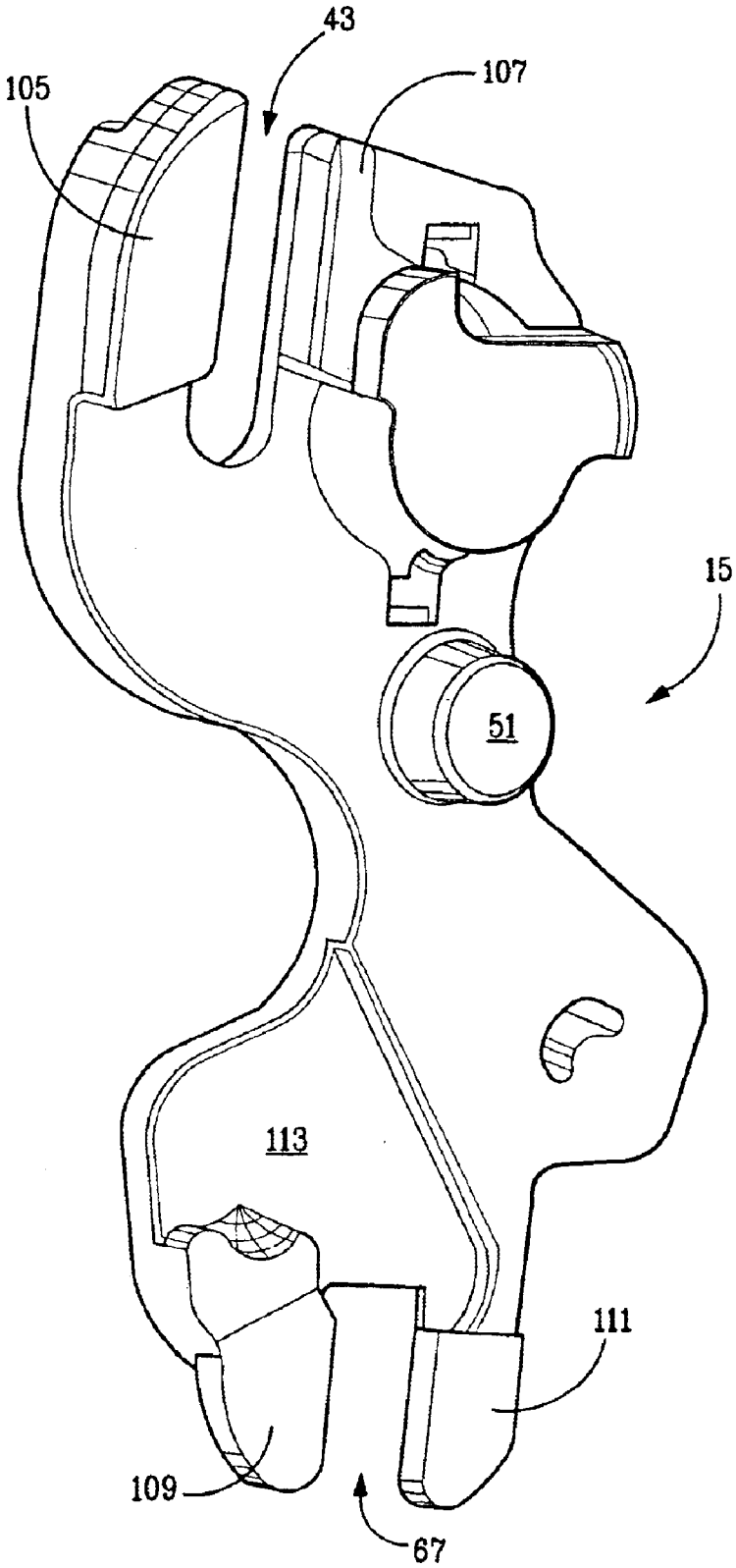
FIG. 13*a* is a left perspective view of the inside face of the movable arm of FIG. 10.
Figure 13B:
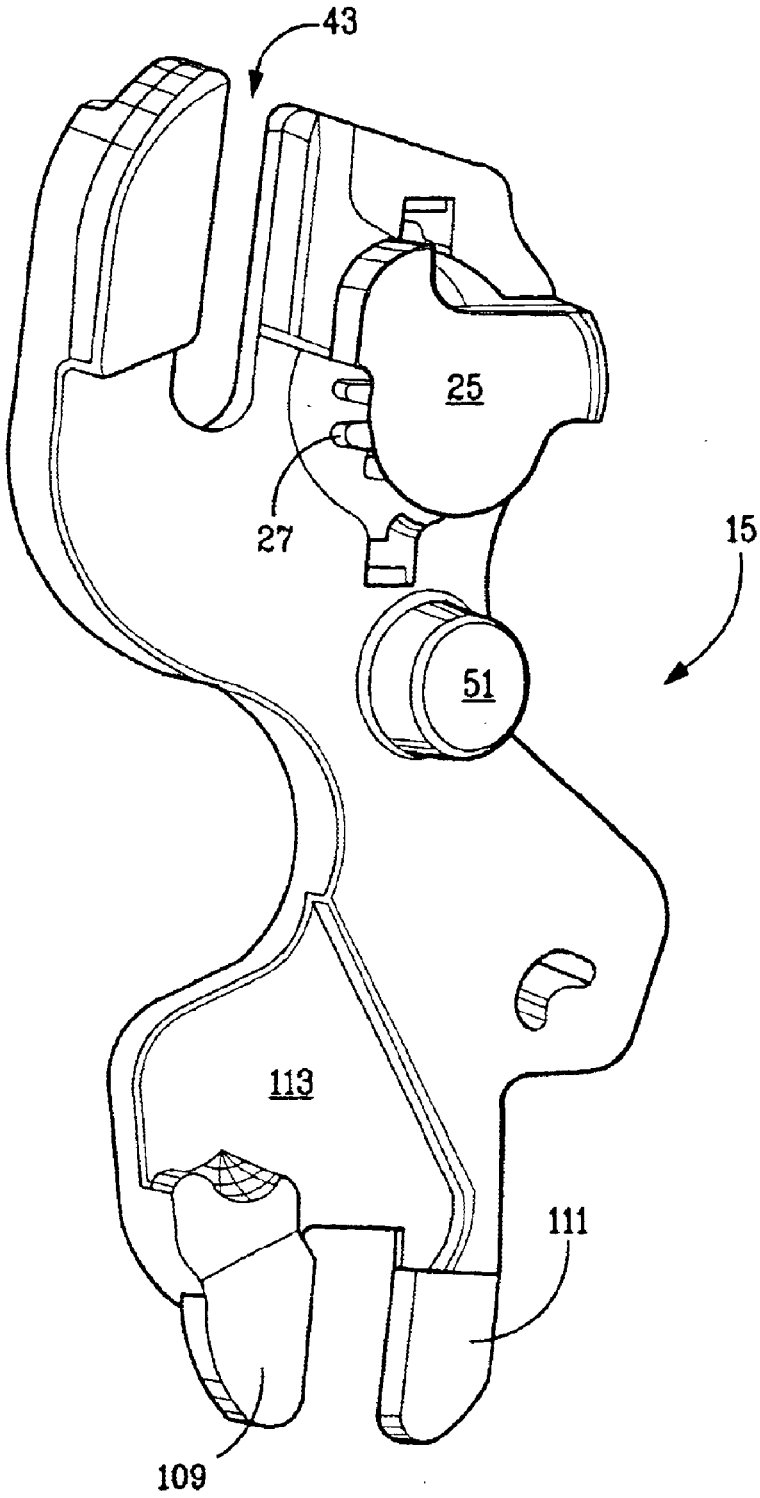
FIG. 13*b* is a left perspective view of the movable arm of FIG. 13*a* with the damper pinion gear installed.
Figure 14A:
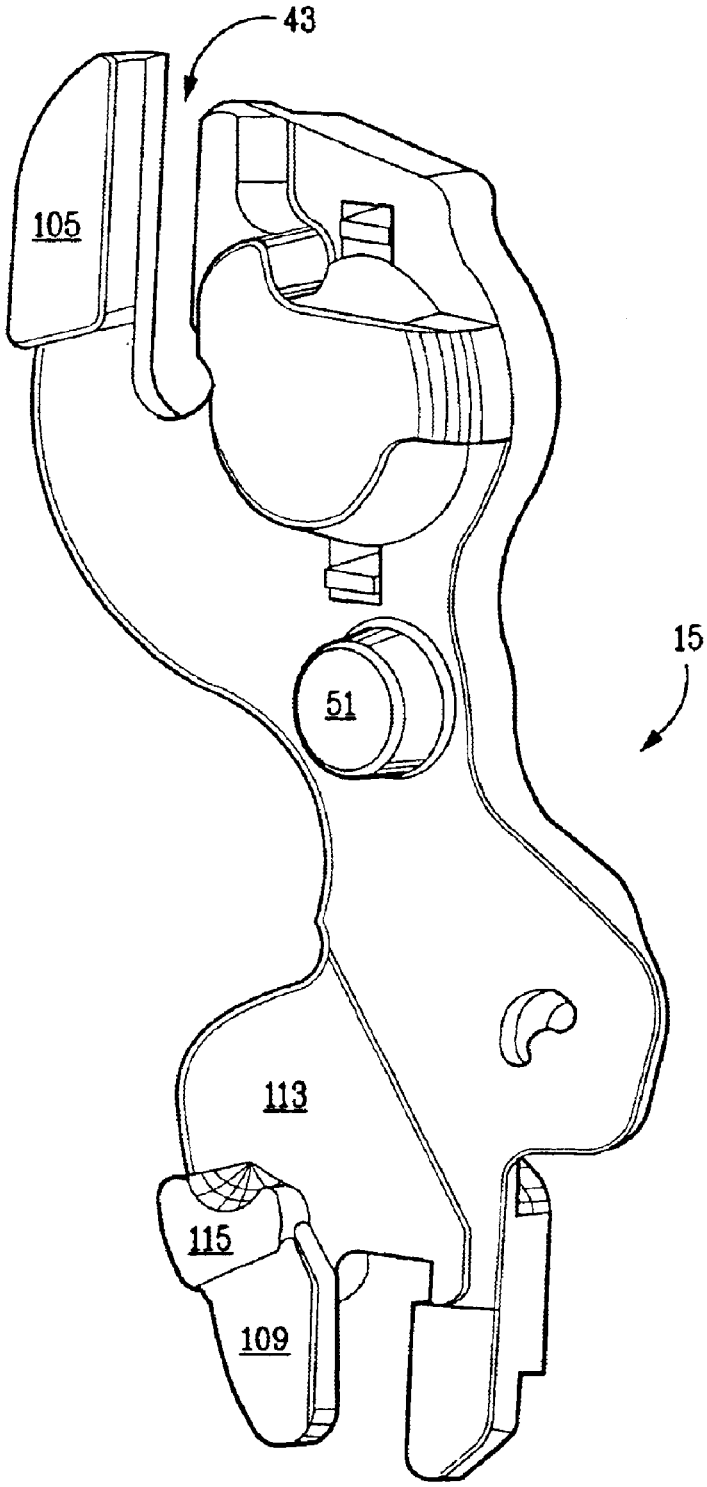
FIG. 14*a* is a right perspective view of the movable arm of FIG. 13*a;*
Figure 14B:
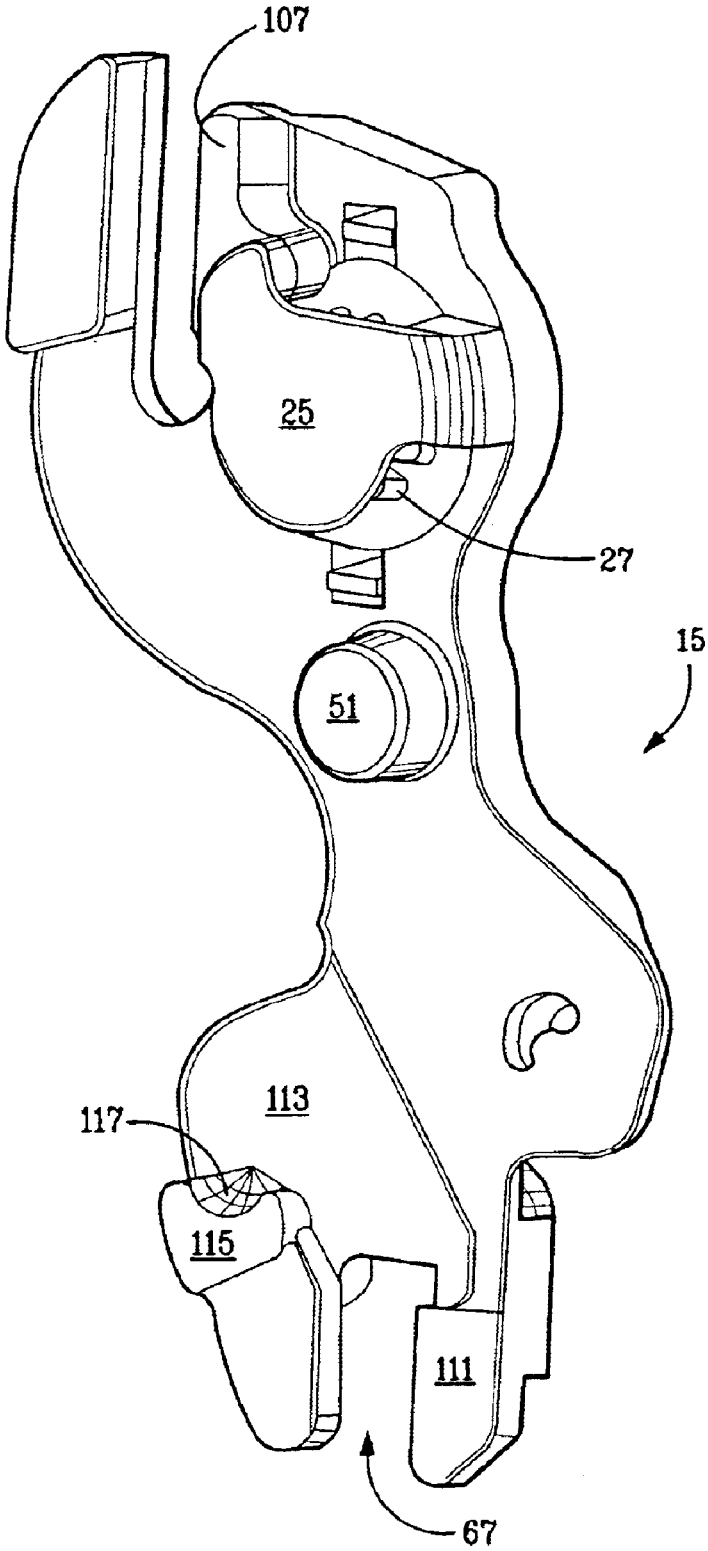
FIG. 14*b* is a left perspective view of the damper installed movable arm of 13*b;*
Figure 15:
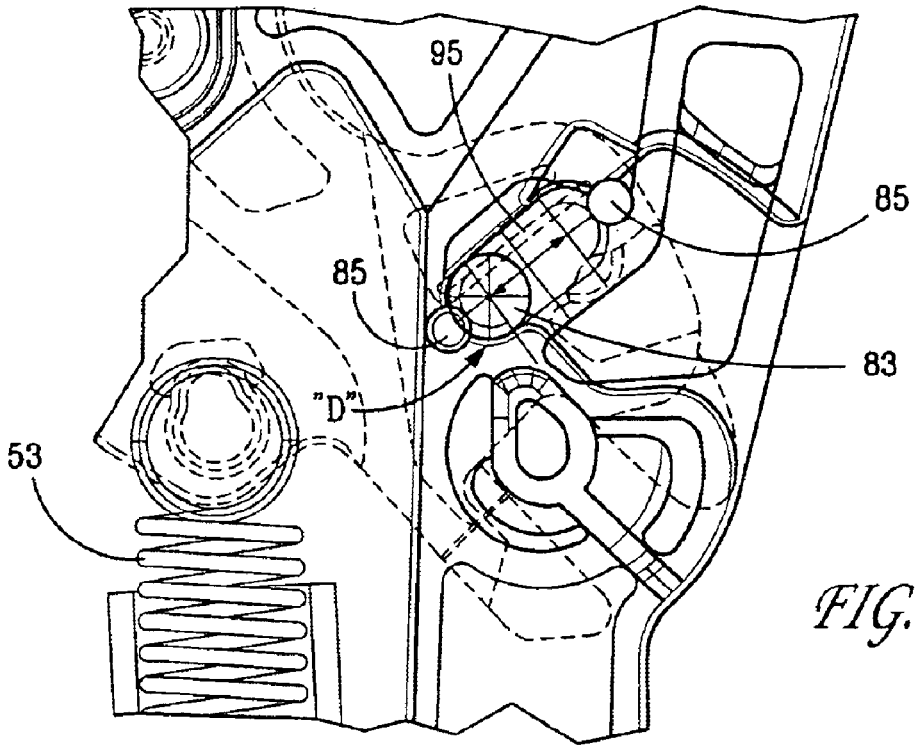
FIG. 15 shows a partial detail view of the movable arm overlaying the fixed arm carrying lockout ball in the non-impact state, non-lockout position for the hinge closed.

FIGS. 13*a*, 13*b*, show a left perspective view of the moving arm 15 inside face, without the damper gear 27 installed, and with the damper gear 27 installed, respectively. FIGS. 14*a*, 14*b* show a right perspective view of the moving arm 15 inside face, without the damper gear 27 installed, and with the damper gear 27 installed, respectively.

FIGS. 15–18 illustrate a partial detail view of the operation of the antigravity ball 83 and the movable arm 15 (foreground) and fixed arm 13 (background). Partial dashed lines are shown as "fine" lines. The antigravity ball 83 is normally free to move up and down thee channel 95 freely when the hinge is closed, FIG. 15. Under no acceleration, the ball 83 stays in the lower channel 95 area "D" due to its own weight, FIG. 15. The spring 53 holds the movable arm 15 in the closed position.

Figure 16:
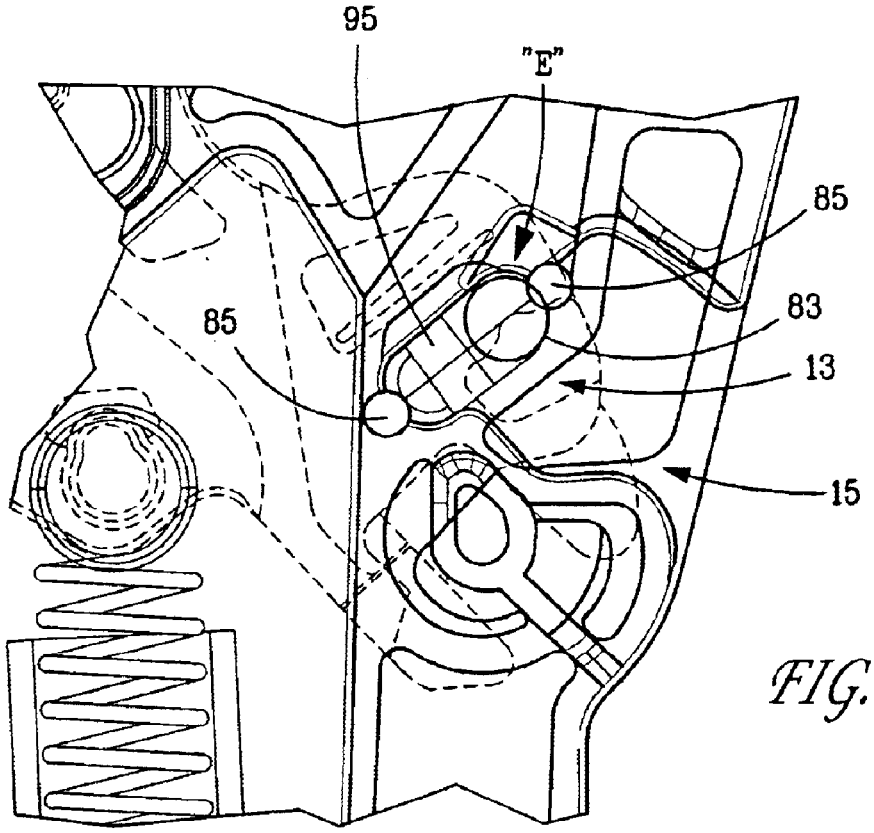
FIG. 16 shows a view of the partial structure of FIG. 15 with the lockout ball in the lockout position after impact or acceleration for the hinge locked.

Under an impact or acceleration, FIG. 16, the ball 83 moves in the direction of acceleration due to the momentum imparted to it. As the ball 83 is designed to have a lower inertia than the movable arm 15 connected to the damper 25 and acting against the spring 53 force, it arrives in the lockout position "E" up the channel before the movable arm 15. The arm 15 then starts to move but is stopped by the ball being in between the two arms 13, 15. In this state the ball 83 becomes cradled between the curved pockets 101, 117 in the bumper/spacer shoulders 99, 115, respectively. These pockets 101, 117 are shown in later figures.

Figure 17:
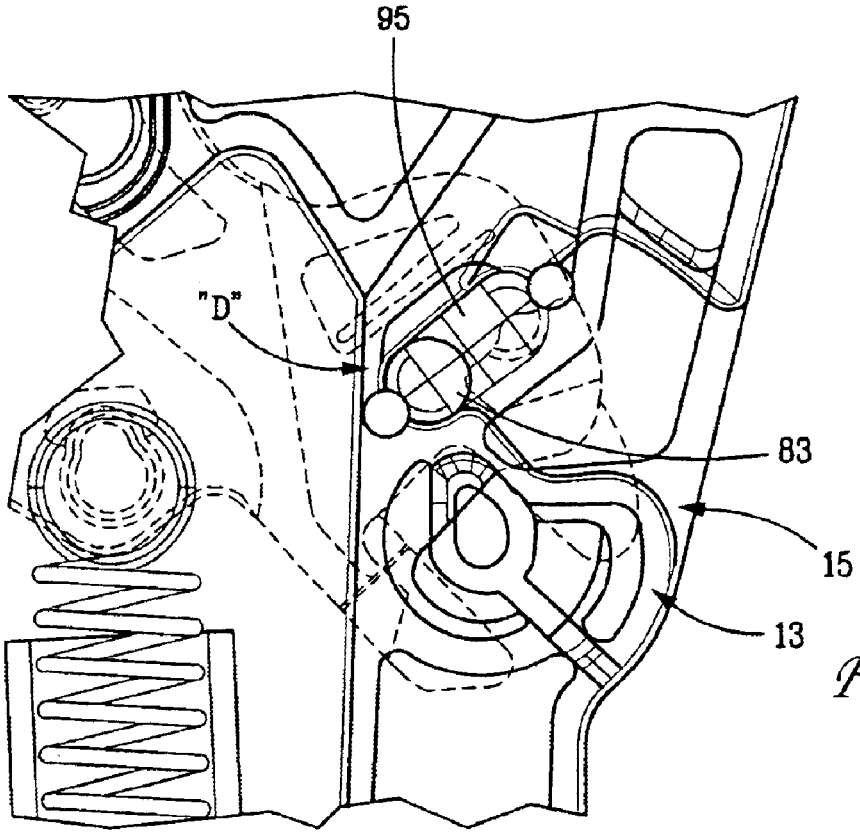
FIG. 17 shows a view of the partial structure of FIG. 15 with the lockout ball in the non-locked position and the hinge opening.

The hinge 11 can open, FIG. 17, under a no impact and no acceleration condition. Here the ball 83 remains in the lower channel, non-lockout location "D" under its own weight. There is no interference with the arms 13, 15. Therefore, when an operator opens the glovebox to which the hinge is connected, the operation of the hinge members 13, 15 continues because the ball 83 remains in the non-interference location "D". The arms 13, 15 do not lock and the hinge mechanism 11 can open with a low effort.

Figure 18:
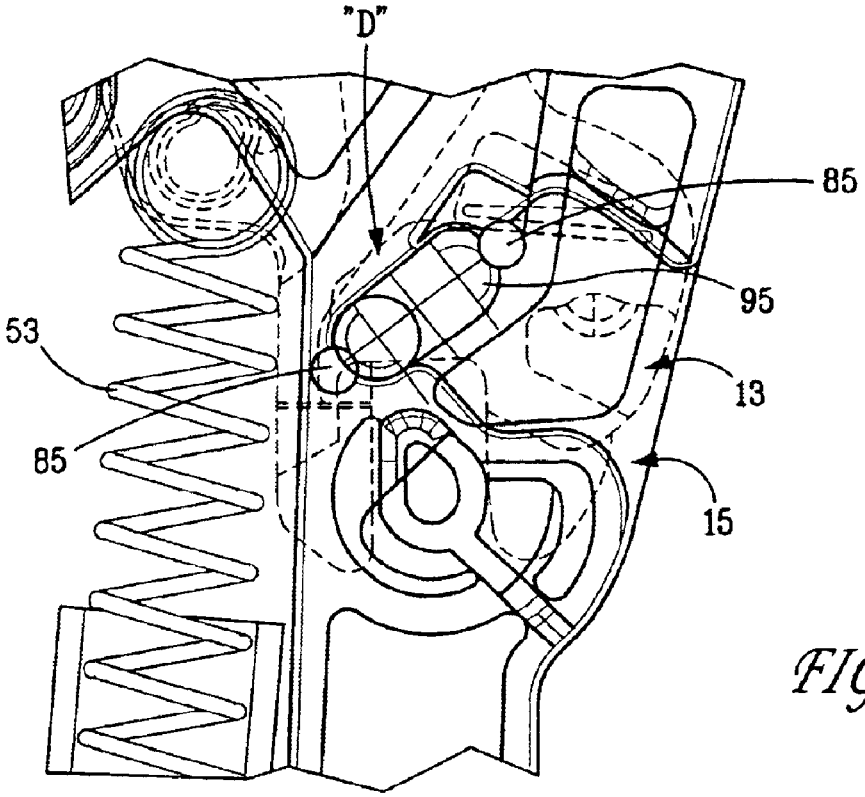
FIG. 18 shows a view of the partial structure and ball position of FIG. 17 with the hinge fully opened.

When the hinge 11 is fully opened, and without acceleration or shock, FIG. 18, the ball 83 remains in the lower channel 95, non-lockout position "D". The arms 13, 15 are free to scissor rotate with respect to one another.

Figure 19:
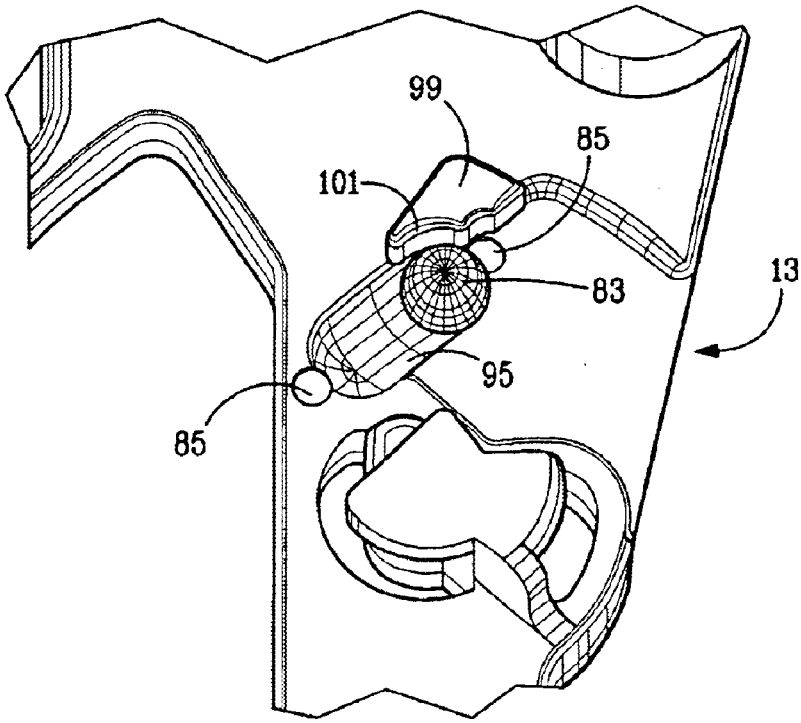
FIG. 19 is a partial detail view of the inside face of the fixed arm of FIG. 12 showing soft touch materials.
Figure 20:
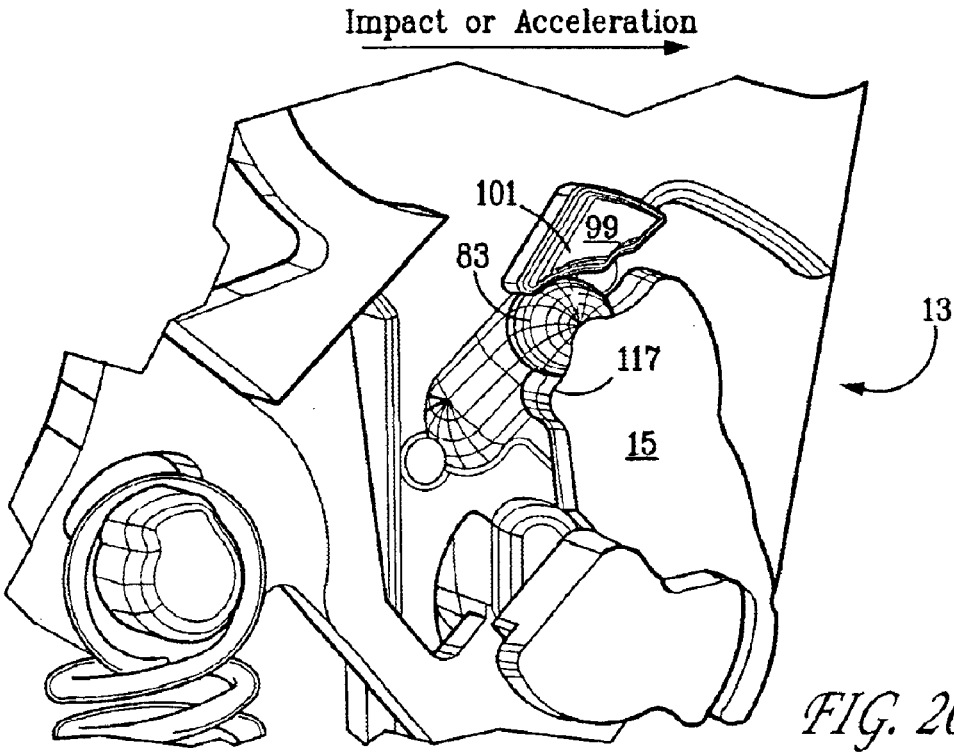
FIG. 20 is a partial detail view of the fixed arm and ball of FIG. 19 with a partial cut-away view of the movable mounted thereon.

FIGS. 19–20 illustrate the use of the TPE soft touch materials 83, over-moulded onto the fixed arm 13 to quiet the antigravity ball 83 operation. These materials 83 at either end of the channel 95 dampen the ball clicking noise when it hits either end. FIG. 20 illustrates the lockout position of the ball 83 against the spacer block 99 and the concave cutouts 101, 117. As previously stated, because of the inertial design the ball 83 arrives at the lockout location between the cutouts 101, 117 before the arms 13, 15 rotate beyond that point, thereby causing a lockout.

Figure 21:
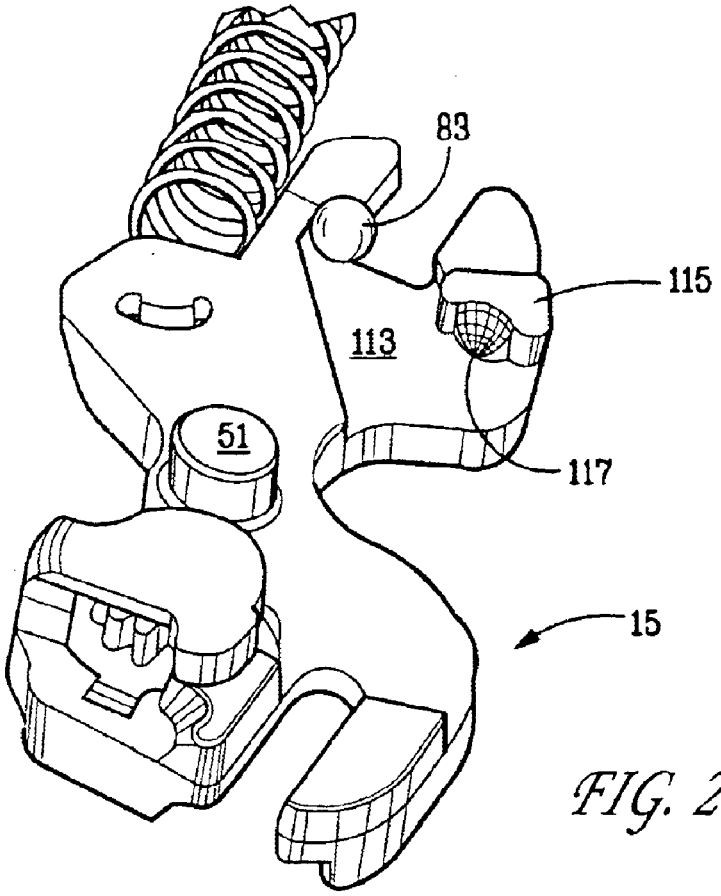
FIG. 21 shows the inside face of the movable arm of FIG. 10 with the ball superimposed for its mating abutted position with the hinge fully open.

FIGS. 21–24 illustrate the position of the antigravity ball 83 with respect to the undercut trapezoidal-like undercut area 113, the second spacer block 115 and its concave cutout 117. FIG. 21 shows the position of the ball 83 against a far shoulder of the undercut area 113 of the movable arm 15, when there is no impact, acceleration or shock, and the weight of the ball has it in its lowest position in the channel 95. The hinge 11 is open.

Figure 22:
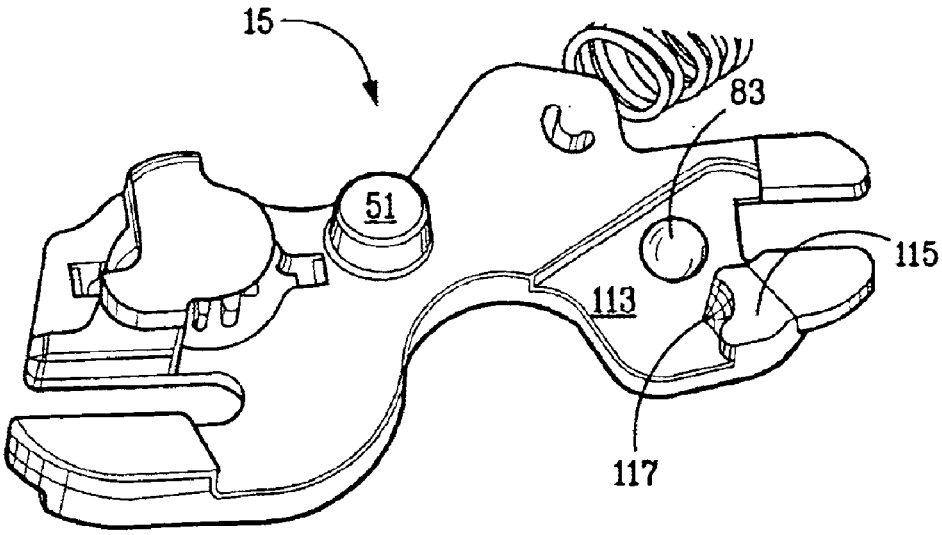
FIG. 22 shows the movable arm and abutted ball of FIG. 21 with the hinge in the closed position.

FIG. 22 shows the hinge 11 closed and there is no impact with the ball 83 at its lowest position in the channel 95. Here the ball 83 is mid-way across the undercut area 1131.

Figure 23:
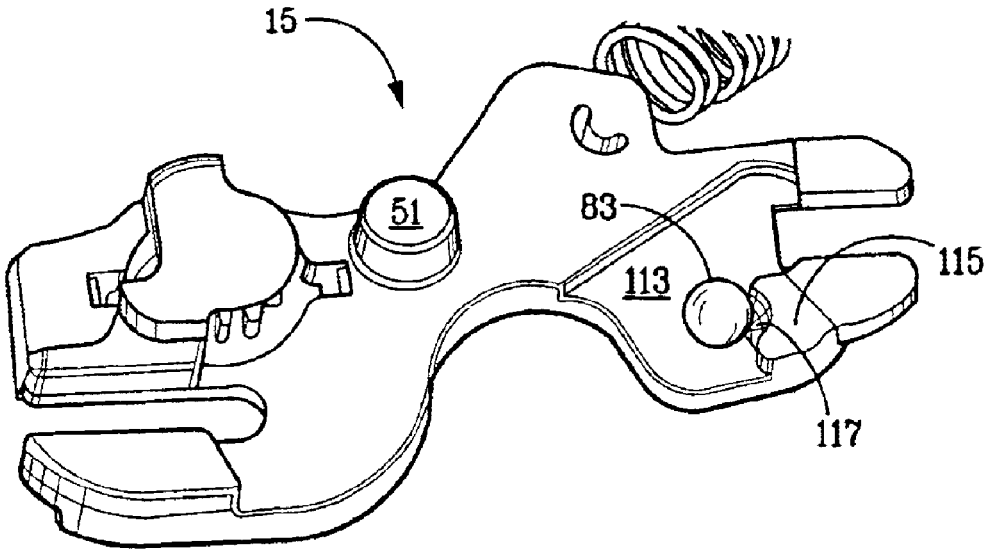
FIG. 23 shows the movable arm and abutted ball of FIG. 21 with the hinge immediately after impact or acceleration.
Figure 24:
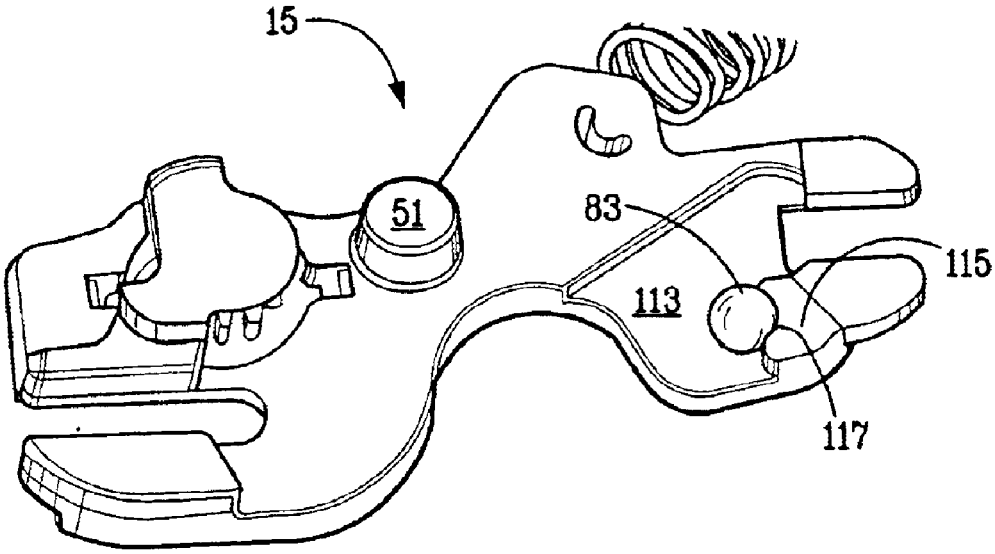
FIG. 24 shows the movable arm and abutted ball of FIG. 21 with the hinge in the fully locked-out closed position.

FIG. 23 illustrates the ball 83 position after a shock or impact drives the ball 83 up the channel 95, wherein the ball 83 moves faster than the movable arm 15 can react to the shock or impact. Here the ball 83 is about in contact with the concave cutout surface 117 in the second spacer/bumper block 115. A fraction of a second later the moving arm 15, FIG. 24 comes into contact with the ball 83 and seats it against the concave cutout 117 when the mating concave cutout 101 in the first block 99 on the fixed arm 13 cradles the ball 83 thereby stopping all motion between the arms 13, 15 at about four degrees of rotation out of the closed position "A".

Figure 25:
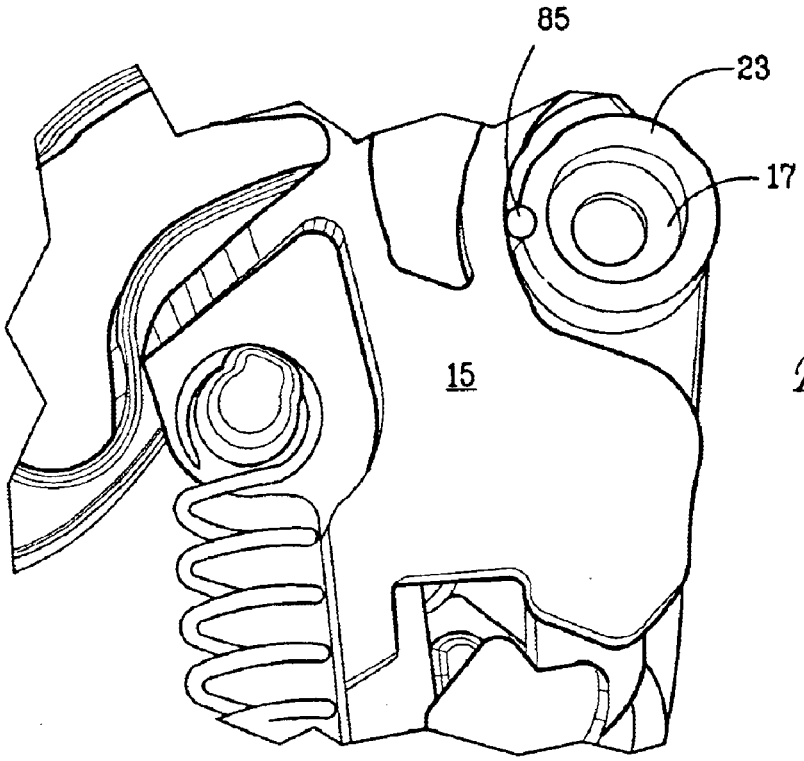
FIG. 25 shows a partial detain of the moving arm as it abuts the fixed arm boss in the fully opened hinge position.
Figure 26:
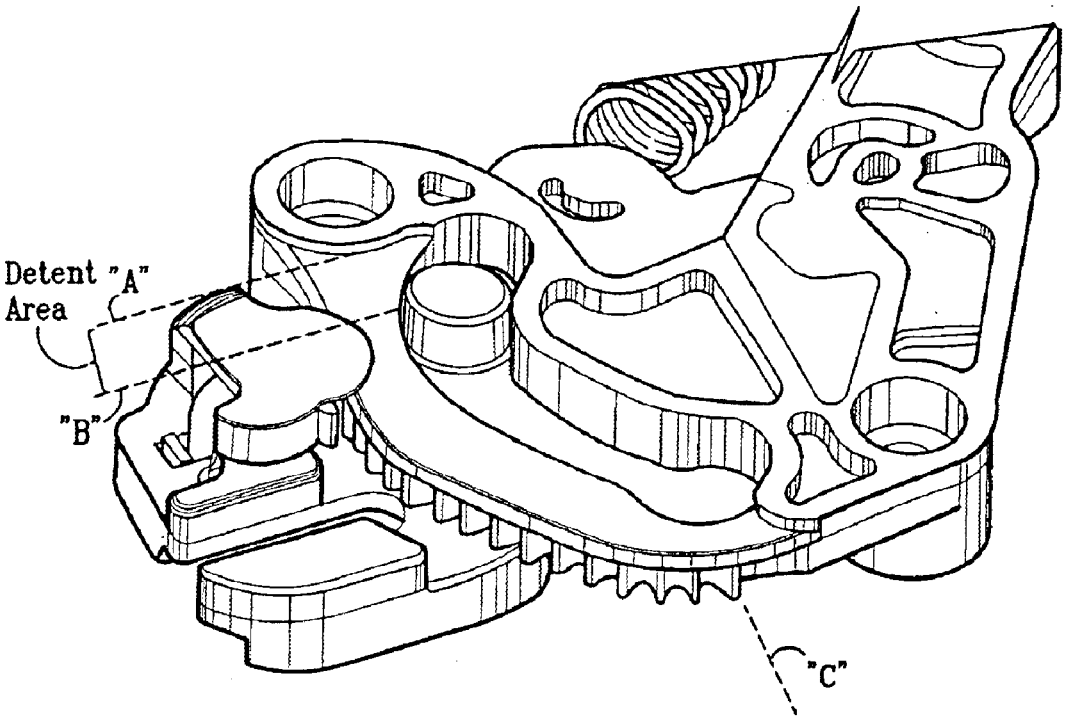
FIG. 26 shows a partial perspective detail view of the movable arm below the fixed arm about to leave the detent area on the damper track.

FIG. 25 illustrates a detail of the soft touch TPE material 85 absorbing the mechanical shock as the moving arm 15 abuts the cylindrical surface 23 at the first mounting boss 17 in the fully open hinge position "C", shown in FIG. 26.

Figure 27:
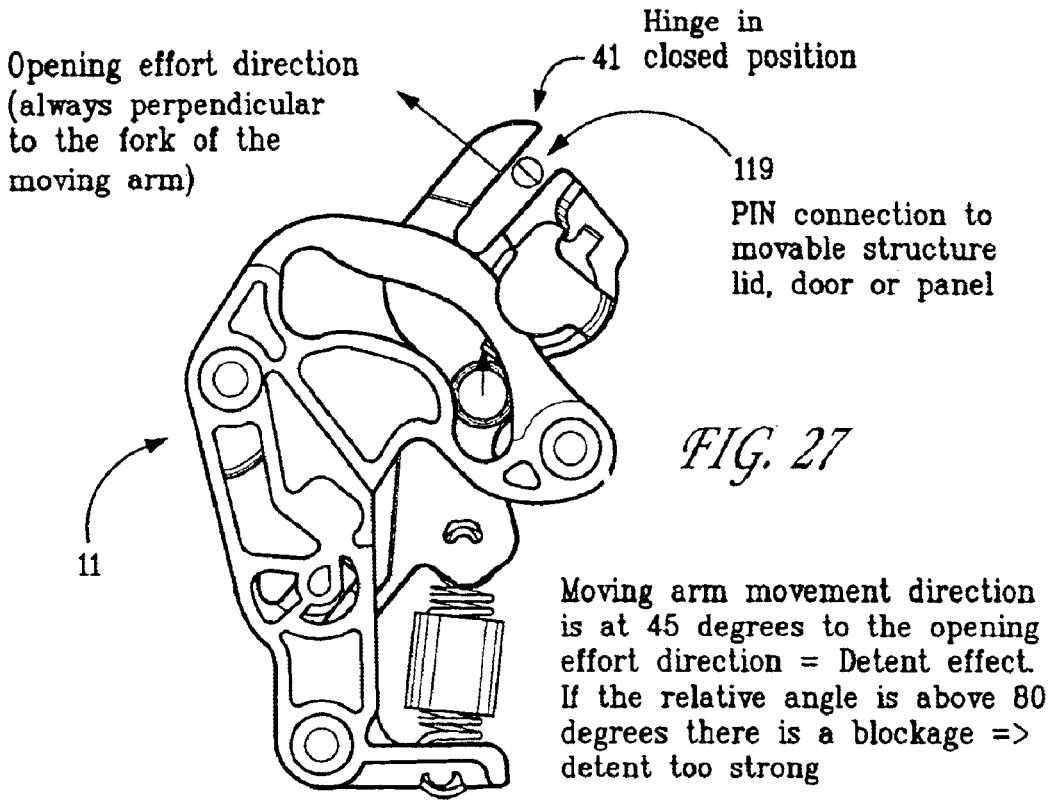
FIG. 27 shows the back view of the assembled hinge of FIG. 2 illustrating movement from the closed detent area position.
Figure 28:
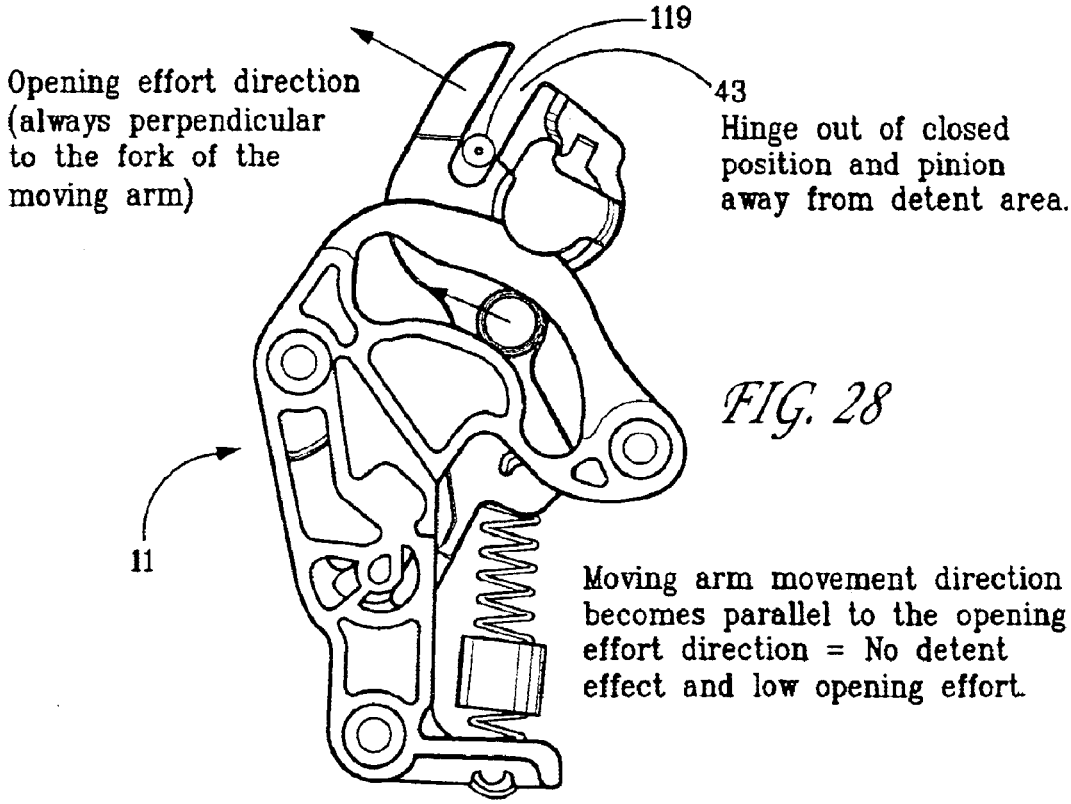
FIG. 28 shows the back view the assembled hinge of FIG. 27 illustrating movement at a position midway long the damper track, in between closed and open positions.

FIG. 26 illustrates the movement of the detent 25 out of the detent area between positions "A" and "B". When the hinge 11 is in the closed position, shown in FIG. 27, the opening effort is in a direction always perpendicular to the fork 41 of the moving arm 15. This fork 41 drives the pin connection 119, with the pin 119 attached to the structure to be moved free to move up and down the fork elongate slot 43, FIG. 28. The movable arm 15 movement direction is generally at 45 degrees to the opening effort direction. This assists create the detent effect at the closed position "A" and the length of the incline defines a "detent area". This area is defined by the incline region 89 of the cam slot, seen in FIGS. 26–28 and in FIG. 7 where it carries its identification numeral.

If the relative angle is decreased to less than 45 degrees, the detent strength is reduced. The detent strength is foremost established by the angle of the incline region 89 which the cam 51 has to climb against the weight of the moveable arm 15 and the spring 53 force. As the angle increases the detent strength increases. Above about 80 degrees there is a "blockage threshold", i.e., the detent strength is too excessive for vehicle installations. Once the pinion gear 27 of the damper structure 25 clears the "detent area" upon the hinge 11 opening, the resistance reduces and the further opening effort needed is greatly reduced, FIG. 28.

Many changes can be made in the above-described invention without departing from the intent and scope thereof. It is therefore intended that the above description be read in the illustrative sense and not in the limiting sense. Substitutions and changes can be made without departing from the scope and intent of the invention.

What is claimed:

1. A momentum lockout hinge mechanism, comprising:

a first fixed member;

a second member connected to said first member and movable in relation thereto;

a pathway positioned on said first member; and a ball positioned for free movement in the pathway from a first position thereof to a second position thereof;

wherein the pathway extends at least partially vertically to cause the ball to move against gravity when momentum is imparted to it thereby moving the ball from the first pathway position to the second pathway position, the momentum is caused by a movement of the hinge mechanism;

wherein the ball interferes with the movement of the first and second members when in the second pathway position.

2. The momentum lockout hinge mechanism of claim 1, also including a cam path on one of the first and second members and a cam on the other of the first and second members, wherein the cam path has a pushout section at one end and a curve out section forming in incline region at the other end, wherein the cam cooperates with each of the ends in a detent function.

3. The momentum lockout hinge mechanism of claim 2, also including a damper connected between the first and second members to diminish the relative rate of movement there between.

4. The momentum lockout hinge mechanism of claim 3, wherein the connection between the first and second member is shaped to permit a rotating motion of said second member with respect to said first member and also a motion of said second member radially from said rotation.

5. The momentum lockout hinge mechanism of claim 4, wherein the cam path and cam operation establish a first closed extreme position for the two members and a second open extreme position.

6. The momentum lockout hinge mechanism of claim 5, wherein when in the closed position the ball is in non-interference to the movement of the first and second members, and wherein when the momentum lockout hinge mechanism is subjected to a shock, the ball begins to move and the second member begins to move relative to the first member, whereby the ball reaches the interference position before the second member can move sufficiently in relationship to the first member to be in the open position.

7. A method of operating a hinge mechanism for momentum lockout comprising the steps of:

permitting two hinge members to rotate with respect to one another, with the second member pivoting with respect to the first member under the operation of an operator from between an open and a closed positions with a pull-push open and a push-pull close operation;

articulating the rotation of the second member in a radial direction to the first member during the beginning portion of the rotation to open;

engaging an anti-gravity lockout member for free movement between a rest position and an interfering position wherein when in the interfering position the lockout member prohibits the rotation of the two hinge members; and permitting the second hinge member to move from a closed position to an open position under a momentum force imparted to the hinge, and the anti-gravity member to move from a non-interfering position to the interfering position under the same imparted momentum force, whereby the anti-gravity member reaches the interfering position before the second hinge member can rotate to the open position with respect to the first hinge member.

8. The method of operation of a hinge mechanism of claim 7, also including detenting the second member with respect to the first member at the open and the closed positions.

9. The method of operation of a hinge mechanism of claim 8, also including dampening the rotational movement of the second member with respect to the first member.

10. The method of operation of a hinge mechanism 9, also including adjusting the detent force at the closed position by adjusting the angle with respect to the vector of gravity of the first member.

11. A hinge mechanism, comprising:

a first fixed arm;

a second movable arm attached to the first arm and rotatably movable in relationship thereto to define a rotated closed position and a rotated open position thereof at the respective extreme positions of rotation;

a channel in said fixed arm, being positioned to extend at least partly upwardly, the channel having a first position and a second position; and a momentum member being freely movable in said channel between the first position and the second position;

wherein when a momentum is imparted to said momentum member by the movement of the hinge mechanism, the momentum member moves to the channel second position wherein when in said second position, said momentum member prohibits the rotation of said second arm with respect to said first arm; and wherein said momentum member returns to said channel first position under the force of gravity.

12. The hinge mechanism of claim 11, wherein said first arm and said second arm are juxtaposedly positioned for scissor-like rotational movement relative there between, and wherein said momentum member is an anti-gravity ball, and wherein said first arm includes a cam slot defining a cam follower path, and wherein said second arm includes a cam extending from the juxtaposed face thereof into said cam slot of said first member.

13. The hinge mechanism of claim 12, wherein said second arm is pivotally attached to said first arm, said pivotal attachment having an elongated opening permitting a radial movement of said second arm with respect to said first arm.

14. The hinge mechanism of claim 13, wherein said cam slot is curvilinear, and said hinge mechanism also includes a damper member operating between said first and second arms for modifying the rotational rate of motion.

15. The hinge mechanism of claim 14, wherein said cam slot includes a detent shape at each end thereof, said cam cooperating with the detent shape at each end of said cam slot to hold a detented position at said open and closed rotated positions of said arms.

16. The hinge mechanism of claim 15 also including a biasing spring connected between said first arm and said second arm, said spring biasing said extreme positions to hold said open and closed rotated positions of said arms.

17. The hinge mechanism of claim 16, wherein said damper member includes a curvalinear toothed track on said first arm and a rotatable pinion gear on said second arm, said pinion gear engaging said curvalinear toothed track, and wherein said pinion gear is connected to a clutch dampener.

18. The hinge mechanism of claim 17, wherein said second arm includes a fork shaped end with an elongate slot, and wherein said second arm includes a heel slot at the opposite end of said arm from said fork shape end, said heel slot operating as the pivot boss for said second arm.

19. The hinge mechanism of claim 18, wherein said first arm has a lobed journal, said lobed journal co-acting with said pivot boss to add an abutment function at said extreme rotated positions.

20. The hinge mechanism of claim 19, wherein said first arm and said second arm each carry an abutment shoulder juxtaposedly extending towards said other arm, each said abutment shoulder having a concave cutout, said respective cutouts engaging said momentum ball at said interference position.

* * * * *

UNITED STATES PATENT AND TRADEMARK OFFICE

CERTIFICATE OF CORRECTION

PATENT NO. : 6,886,222 B2
APPLICATION NO. : 10/617576
DATED : May 3, 2005
INVENTOR(S) : Fabrice Vitry It is certified that error appears in the above-identified patent and that said Letters Patent is hereby corrected as shown below:

Column 4, line 54, insert --a-- between “is” and “frontal”;

Column 5, line 10, insert --8-- after “FIG.”;

Column 5, line 35; insert --arm-- before “mounted thereon.”;

Column 5, line 54, replace “long” with --along--;

Column 6, line 3, replace “a” with --at--;

Column 6, line 20, replace “and” with --an--;

Column 6, line 26, delete “is” between “FIG. 2” and “shows”;

Column 6, line 38, replace “and” with --an--;

Column 8, line 51, replace “closes” with --closed--;

Column 8, line 68, replace “thee” with --the--;

Column 9, line 49, replace “1131” with --113--;

Column 10, line 6, delete “assists” and replace “create” with --creates--;

Column 12, Claim 17, lines 2 and 4, replace “curvalinear” with --curvilinear--.

Signed and Sealed this

Twenty-ninth Day of August, 2006

JON W. DUDAS
*Director of the United States Patent and Trademark Office*